US007121660B2

(12) United States Patent
Ide et al.

(10) Patent No.: US 7,121,660 B2
(45) Date of Patent: Oct. 17, 2006

(54) PRINT PRODUCING METHOD AND PRINT PRODUCING APPARATUS

(75) Inventors: Daisaku Ide, Tokyo (JP); Hiroyuki Ogino, Kanagawa (JP); Masanori Ito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 228 days.

(21) Appl. No.: 10/676,427

(22) Filed: Sep. 30, 2003

(65) Prior Publication Data

US 2004/0169710 A1 Sep. 2, 2004

(30) Foreign Application Priority Data

Sep. 30, 2002 (JP) ..... 2002-287829
Sep. 30, 2002 (JP) ..... 2002-287830

(51) Int. Cl.
*B41J 2/01* (2006.01)

(52) U.S. Cl. ..... 347/101; 347/95; 347/9

(58) Field of Classification Search ..... 347/100, 347/96, 95, 101, 102, 5, 19, 42, 43, 40, 9; 106/31.6, 31.27, 31.13; 523/160
See application file for complete search history.

(56) References Cited

U.S. PATENT DOCUMENTS 4,732,786 A * 3/1988 Patterson et al. ..... 347/105
4,879,166 A 11/1989 Misuda et al.
5,104,730 A 4/1992 Misuda et al.
6,193,361 B1 * 2/2001 Wen ..... 347/96
6,848,781 B1 * 2/2005 Ogino et al. ..... 347/100

FOREIGN PATENT DOCUMENTS

| | | | |
|---|---|---|---|
| JP | 2-276670 | | 11/1990 |
| JP | 4-37576 | | 2/1992 |
| JP | 5-19660 | | 1/1993 |
| JP | 5-32037 | | 2/1993 |
| JP | 5-208508 | | 8/1993 |
| JP | 05-208508 | * | 8/1993 |
| JP | 2001-212996 | | 8/2001 |

* cited by examiner

*Primary Examiner*—Manish S. Shah
(74) *Attorney, Agent, or Firm*—Morgan & Finnegan LLP

(57) ABSTRACT

Individual droplets of a liquid composition landing on a printing medium during one pass (one scan) are connected to the respective adjacent droplets and integrated with them to form a flat coat layer. Thus, the surface of the coat layer is almost flat, thus increasing the amount of regularly reflected light. This increases the degree of gloss. When the liquid composition is ejected during two passes, a smaller number of droplets of the liquid composition can be connected together than in the case of one pass. Thus, the droplets are not completely integrated and start to be insolubilized before the second scan. In this manner, the individual droplets are insolubilized while maintaining their original shapes. The resultant coat layer has a surface with many concaves and convexes. Consequently, the degree of gloss decreases.

18 Claims, 20 Drawing Sheets

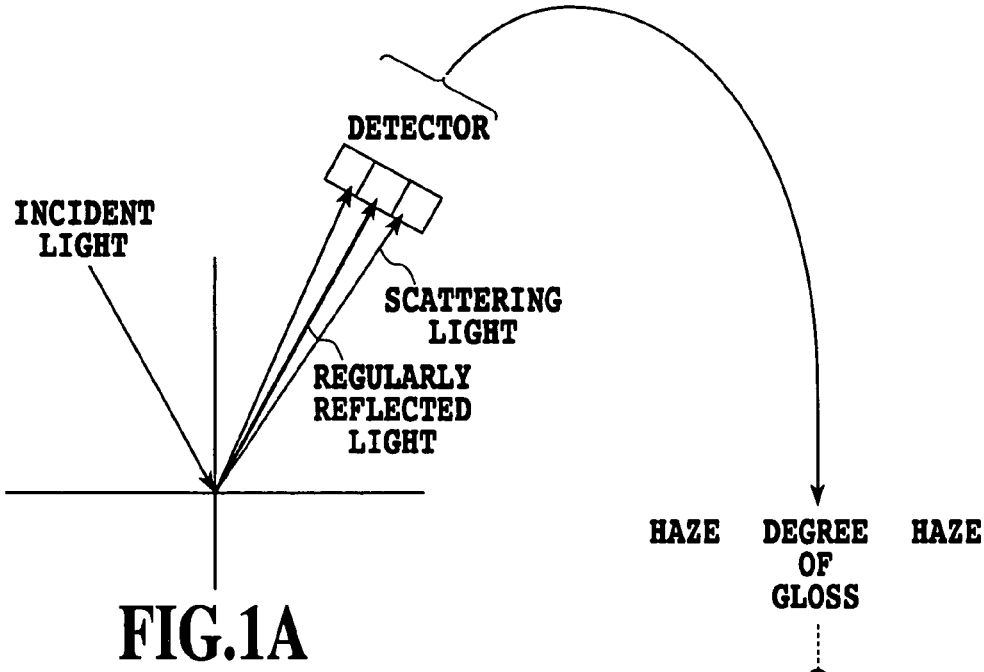
FIG.1A
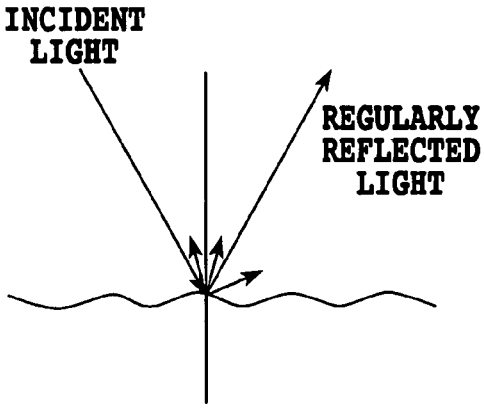
FIG.1B
FIG.1D
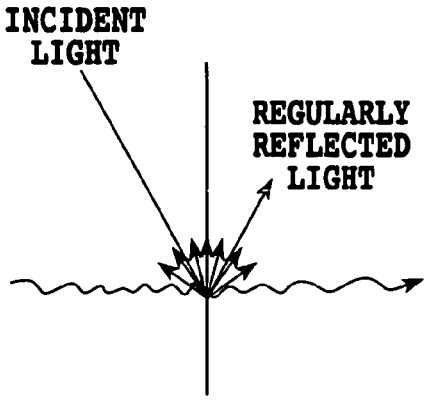
FIG.1C

| DEGREE OF GLOSS | HAZE |
|---|---|
| 79.5 | 3.3 |
| 59.9 | 10.1 |
| 53.8 | 12.3 |
| 49.8 | 11.8 |
| 37.9 | 16.4 |
| 37.2 | 17 |
| 37.4 | 16.1 |

| DEGREE OF GLOSS | HAZE |
|---|---|
| 92 | 3 |
| 88 | 4.4 |
| 84.2 | 7.1 |
| 74.9 | 9.7 |
| 69.9 | 10.9 |
| 61 | 12.3 |
| 49.3 | 15.1 |
| 55.2 | 16.2 |

PRINT PRODUCING METHOD AND PRINT PRODUCING APPARATUS

This application claims priority from Japanese Patent Application Nos. 2002-287829 filed Sep. 30, 2002 and 2002-287830 filed Sep. 30, 2002, which are incorporated hereinto by reference.

BACKGROUND OF THE INVENTION

1. Field of the Invention

The present invention relates to a print producing method and a print producing apparatus, and more specifically, to a print producing method and a print producing apparatus which control the gloss of an image or the like in a print.

2. Description of the Related Art

There are now various types of printing apparatuses, by which prints are obtained to be different in the impression of the gloss of an image or the like therein depending on the type of the printing apparatus. With an electro-photographic method using toner as a color material or a thermal transfer method using ink ribbons as a color material, basically layers of these color materials are formed on a surface of a printing medium to provide a specified smoothness. This makes a printed image glossy.

On the other hand, printing apparatuses of an ink jet method using liquid ink are becoming rapidly popular, for such reasons as the easiness with which they can be handled, in applications for outputting information or images from various devices including information processing devices. The apparatuses of the ink jet method can easily form multicolor images. Furthermore, in terms of printing grades, prints provided by these apparatuses can easily stand comparison with multicolor prints based on a plate making method and printed images based on a color photography method. Accordingly, these apparatuses are applied even to the field of full color image printing.

With the ink jet method, ink permeates a printing medium to form an image and basically does not form any layers. Accordingly, printed images provided by this method are less glossy than those provided by other methods of fixing color material layers to the surface of a printing medium.

Printing medium provided with a coat layer composed of an alumina hydrate of a boehmite structure is disclosed in, for example, U.S. Pat. Nos. 4,879,166, 5,104,730, Japanese Patent Application Laid-open No. 2-276670 (1990), Japanese Patent Application Laid-open No. 4-037576 (1992), and Japanese Patent Application Laid-open No. 5-032037 (1993). These printing media provided with a coat layer composed of an alumina hydrate have the advantageous described below. Since the alumina hydrate has positive charges, ink dyes are firmly fixed to these printing media, resulting in well-colored images. Further, these printing media are more preferable than conventional printing media in terms of image quality, notably the quality of full color images as well as gloss. Thus, images as glossy as silver salt photographs can be obtained by applying, for example, dye-based ink to a printing medium provided with gloss by being coated with the alumina hydrate.

On the other hand, there have been various demands for printed images in connection with the gloss described above. Some demand is that images are printed with arranging both glossy and non-glossy parts within the same printing medium rather than making the entire printing medium uniformly glossy as described in the above documents. For example, during the recent business discussions on real estates, relevant buildings or rooms created by CG (Computer Graphics) are often viewed on a WEB site or a monitor. If any of the materials of a building displayed on the monitor is expressed by gloss, when this building is printed on a printing medium, the gloss may not be reproduced. Thus, the buildings or rooms may not be conveniently checked using this printed medium. Further, in the field of dress design, the expression of impressions of materials is important. Printouts in this field create a problem similar to that described above. This is because when a printing medium is printed, the degree of gloss on this printing medium is uniform. With a printing apparatus that can freely vary the degree of gloss even within the same printing medium, even the impressions of materials can be properly expressed. For example, in online shopping, which is expected to become popular, with a printing apparatus that can faithfully express the materials of an article displayed on a monitor, including the gloss of the materials, it is obvious that this apparatus can be conveniently used to check the article.

In this regard, the assignee of this application has proposed in Japanese Patent Application Laid-open No. 5-019660 (1993) an image forming apparatus that can partly vary the degree of gloss within the same printing media. More specifically, this application describes an arrangement for fixing a toner image transferred to a printing medium wherein a fixing temperature is varied in a direction in which a printing medium is conveyed, to vary the degree of gloss among the areas of the printing medium in this direction. Alternatively, in this arrangement, a thermal head is divided in association with the areas of the printing medium and the fixing temperature is varied among the pieces into which the head is divided, to vary the degree of gloss. This document also describes the variation of the degree of gloss among a plurality of levels based on the control of the fixing temperature.

Further, for a thermal transfer apparatus, Japanese Patent Application Laid-open No. 2001-212996 describes a similar proposal. This document describes the transfer of an overcoat layer to a printing medium on which an image has been formed using ink ribbons. In this document, the transfer temperature of the thermal head is varied between glossy parts and non-glossy parts, to vary partly the degree of gloss within the same printing medium.

Furthermore, Japanese Patent Application Laid-open No. 5-208508 (1993) (Paragraphs 0048 to 0055 and FIGS. 13 to 15) discloses a thermal transfer-based printing technique similar to that of Japanese Patent Application Laid-open No. 2001-212996. This document also describes a solid ink jet method using colorless or transparent hot-melt ink wherein gloss is provided by forming a layer on an image printed on a printing medium using the liquid ink.

However, it is impossible to employ the technique disclosed in Japanese Patent Application Laid-open No. 5-019660 (1993), Japanese Patent Application Laid-open No. 2001-212996, or Japanese Patent Application Laid-open No. 5-208508 (1993), described above, for printed images based on the ink jet method, which is currently most popular, or employing these techniques involves difficulties.

Specifically, the technique of controlling the fixing temperature to vary the degree of gloss as disclosed in Japanese Patent Application Laid-open No. 5-019660 (1993) is uniquely applicable to toner as a color material but not to printing media already printed using ink.

Further, the techniques disclosed in Japanese Patent Application Laid-open No. 2001-212996 and Japanese Patent Application Laid-open No. 5-208508 (1993) form a layer on a printing medium which is separate from a color material. To allow an ink-jet-based printing apparatus to provide such a layer, it is necessary to provide a separate apparatus for this purpose. This complicates the configuration of the printing apparatus. More specifically, Japanese Patent Application Laid-open No. 2001-212996 has only to provide an extra ribbon for an overcoat layer and allows a thermal head for printing to be used for thermal transfer without modifying the thermal head. Accordingly, the configuration of the printing apparatus is not complicated. As opposed to this, the ink jet method requires a separate thermal head and the like. This also applies to the arrangement disclosed in Japanese Patent Application Laid-open No. 5-208508 (1993). For example, as shown in FIG. 15 of this document, it is necessary to provide two head scanning mechanisms for printing and for layer formation respectively. This may complicate the configuration of the printing apparatus and increase its size. Further, with the arrangement disclosed in this document, a head for layer formation melts a solid and then ejects the resultant liquid. Accordingly, one printing apparatus has two heads for the respective methods and thus has a complicated configuration and an increased size. Further, a control arrangement for ejections from the heads is complicated.

Furthermore, if the technique disclosed in Japanese Patent Application Laid-open No. 2001-212996, or Japanese Patent Application Laid-open No. 5-208508 (1993) is applied to the ink jet method, various advantages of the inkjet method may be impaired, such as the easiness with which the ink jet-based printing apparatus can be handled.

Further, for images displayed on a monitor or photographed by a camera, their gloss is not uniform. In most cases, these images each have a plurality of degrees of gloss. Thus, if these images are printed, it is desirable to be able to express plural degrees of gloss and faithfully reproduce the images displayed on the monitor or the like. However, Japanese Patent Application Laid-open No. 2001-212996 and Japanese Patent Application Laid-open No. 5-208508 (1993), described above, simply sets the presence or absence of gloss by forming or not forming a layer, respectively. Consequently, plural degrees of gloss cannot be obtained. In this regard, Japanese Patent Application Laid-open No. 5-019660 (1993) describes the method of varying the fixing temperature and thus the degree of gloss among a plurality of levels. However, the mechanism of this method is different from that of the apparatus that creates gloss by forming a layer. Consequently, it cannot be applied to ink jet-based printing.

On the other hand, in the field of ink jet printing, the ability to preserve an image in a printed matter is a relatively important object. Printed images based on the ink jet method are likely to be degraded by a trace of ozone present in the atmosphere. Accordingly, the grade of images observed immediately after printing may not be maintained for a long time. In such a case, the value of the prints may decrease.

SUMMARY OF THE INVENTION

An object of the present invention is to provide a print producing method and a print producing apparatus which can use simple arrangements to express the impression of gloss at a plurality of levels and which enable images to be preserved more properly.

Further, with what is called a "serial method", which uses a head of an ink jet method to scan a printing medium while ejecting and applying a liquid composition to the printing medium, ejected droplets are connected together and become insoluble on the print to form a layer, and then, the droplets connected together immediately after ejection are raised from their end toward center owing to their surface tension. As a result, a layer formed may make gloss non-uniform or form interference fringes. the another object of the present invention is to provide a print producing method and a print producing apparatus which prevent the layer from being raised and which provide prints free from non-uniform gloss or interference fringes.

In the first aspect of the present invention, there is provided a print producing method of producing a print with varying a degree of gloss of a printing medium, the method comprising the steps of:

applying ink including a printing material to the printing medium; and applying a predetermined liquid droplet different from the ink to the printing medium to which the ink has been applied, wherein the application of the predetermined liquid droplet causes the degree of gloss to be varied among a plurality of levels.

In the second aspect of the present invention, there is provided a print producing method of producing a print including parts which are different in a degree of gloss to each other, the method comprising the step of:

applying a predetermined liquid droplet reacting with a surface of a printing medium to the surface of the printing medium, wherein the step applies the predetermined liquid so that a plurality of the parts different in the degree of gloss exist on the surface of the printing medium.

In the third aspect of the present invention, there is provided a print producing method of producing a print including parts which are different in a degree of gloss to each other, the method comprising the step of:

ejecting ink to a printing medium from an ink jet head while the ink jet head is employed to scan the printing medium; and ejecting a predetermined liquid droplet from an ink jet head to a printing medium to which ink has been ejected while the ink jet head is employed to scan the printing medium so that the numbers of times of scan are differentiated to form the plurality of parts, wherein the plurality of parts different in the number of scan have different degree of gloss respectively.

In the fourth aspect of the present invention, there is provided a print producing method of producing a print with varying a degree of gloss of a printing medium, the method comprising the step of:

ejecting a predetermined liquid droplet reacting with the printing medium to the printing medium from an ink jet head while the ink jet head is employed to scan the printing medium, wherein the number of times of scan required for ejecting the predetermined liquid droplet is varied to vary the degree of gloss.

In the fifth aspect of the present invention, there is provided a print producing method of producing a print including parts which are different in a degree of gloss to each other, the method comprising the step of:

ejecting ink to a printing medium from an ink jet head while the ink jet head is employed to scan the printing medium; and ejecting a predetermined liquid droplet from an ink jet head to a printing medium to which ink has been ejected while the ink jet head is employed to scan the printing medium at a plurality of times, wherein respective masks are employed to generate ejection data for the plurality of times of scan and the predetermined liquid droplet is ejected based on the ejection data generated by employing the masks, to form the parts, wherein the step of ejecting a predetermined liquid droplet employs a plurality of masks different in the size of minimum unit of the mask and employs the plurality of masks to form a plurality of parts different in a degree of gloss, and the plurality of parts different in the number of scan have different degree of gloss respectively.

In the sixth aspect of the present invention, there is provided a print producing method of producing a print with varying a degree of gloss of a printing medium, the method comprising the step of:

ejecting a predetermined liquid droplet reacting with the printing medium from an ink jet head to a printing medium while the ink jet head is employed to scan the printing medium at a plurality of times, wherein respective masks are employed to generate ejection data for the plurality of times of scan and the predetermined liquid droplet is ejected based on the ejection data generated by employing the masks, to form a layer, wherein the step of ejecting a predetermined liquid droplet varies a minimum unit of the mask to vary the degree of gloss.

In the seventh aspect of the present invention, there is provided a print producing method which uses a liquid head provided with a plurality of ejection openings and ejecting a predetermined liquid to employ the liquid head for scanning a printing medium in a direction different to a direction in which the plurality of ejection openings are arranged, and to eject the predetermined liquid from the liquid head to the printing medium to form a layer, so that a print is produced with varying a degree of gloss, wherein respective ejection amounts of ejection openings are varied in accordance with positions in the arranging direction of the plurality of ejection openings.

In the eighth aspect of the present invention, there is provided a print producing apparatus for producing a print with varying a degree of gloss of a printing medium, the apparatus comprising:

layer forming means for applying a liquid to form a layer, wherein the formation of the layer causes the degree of gloss to be varied among a plurality of levels.

In the ninth aspect of the present invention, there is provided a print producing apparatus for producing a print with varying a degree of gloss of a printing medium, the apparatus comprising:

layer forming means for applying a liquid to form a layer, wherein the layer forming means is means for forming the layer by applying a predetermined liquid droplet, and the means controls a level of integrating a plurality of the predetermined liquid droplets, which are applied for forming the layer, to vary the degree of gloss.

In the tenth aspect of the present invention, there is provided a print producing apparatus for producing a print with varying a degree of gloss of a printing medium, the apparatus comprising:

layer forming means for ejecting a predetermined liquid droplet to the printing medium from an ink jet head while the ink jet head is employed to scan the printing medium to form a layer on the printing medium, wherein the number of times of scan required for forming the layer is varied to vary the degree of gloss.

In the eleventh aspect of the present invention, there is provided a print producing apparatus which uses a liquid head provided with a plurality of ejection openings and ejecting a predetermined liquid to employ the liquid head for scanning a printing medium in a direction different to a direction in which the plurality of ejection openings are arranged, and to eject the predetermined liquid from the liquid head to the printing medium to form a layer, so that a print is produced with varying a degree of gloss, wherein respective ejection amounts of ejection openings are varied in accordance with positions in the arranging direction of the plurality of ejection openings.

According to the above structure, the predetermined droplets are applied to the surface of the printing medium to form a layer so as to vary the degree of gloss of, for example, an image printed on the printing medium among a plurality of levels. Consequently, the degree of gloss can be varied among a plurality of levels simply by varying the manner of applying the droplets in forming the layer.

Further, according to another structure, when the predetermined droplets are applied to the surface of the printing medium to form a layer, the degree of gloss is varied, for example, by controlling the level of integration of the predetermined droplets applied to form the layer. This makes it possible to get the shapes and sizes of the plurality of droplets applied to the printing medium when they are integrated. Thus, the degree of gloss can be varied by controlling the irregularity or roughness of the surface of the layer.

Further, in the above structure, when the ink jet head is used for scanning the printing medium to eject the predetermined droplets to form a layer, the degree of gloss can be varied by varying the number of scans or data on each scan.

Furthermore, since the above layer is formed on the surface of the printing medium on which the image is formed, the image can be closed relative to the atmosphere.

According to another structure, the liquid head provided with the plurality of ejection openings and ejecting the predetermined liquid is employed for scanning in the direction different from that in which the plurality of ejection openings are arranged. Then, the head ejects the predetermined droplets to the printing medium to form a layer on it to provide the image with gloss. Inn this case, the amount of the predetermined liquid ejected is varied for each of the plurality of ejection openings in accordance with the position of this ejection opening in the arrangement direction. Accordingly, it is possible to increase the amount of liquid ejected from the ejection opening located at an end of the ejection opening arrangement and adjacent to the boundary of the scan area with the head and from which the predetermined liquid is ejected, compared to the other ejection openings. This makes it possible to prevent a decrease in the thickness of the layer, notably at the boundary of the scan area, the layer being formed by insolubilizing the predetermined liquid on the printing medium during each scan. It is thus possible to suppress a variation in the shape of the layer at the boundary of the scan area. As a result, the nonuniformity of gloss or the occurrence of interference fringes can be prevented which is caused by a variation in the thickness of the layer at the boundary.

The above and other objects, effects, features and advantages of the present invention will become more apparent from the following description of embodiments thereof taken in conjunction with the accompanying drawings.

BRIEF DESCRIPTION OF THE DRAWINGS

FIGS. 1A to 1D are diagrams illustrating the degree of gloss and haze;

DETAILED DESCRIPTION OF PREFERRED EMBODIMENTS

Embodiments of the present invention will be described below with reference to the drawings.

First, description will be given of a degree of gloss and a haze controlled according to the embodiments of the present invention and used as references in evaluating printed images. A very glossy surface may appear white and cloudy (this will referred to as "haze" in this specification). Thus, even with gloss, if haze is observed, the impression of the gloss in a printed image varies correspondingly. Thus, in the embodiments of the present invention, control is executed as described later in order to provide the printed image not only with a desired degree of gloss but also with a desired haze.

FIGS. 1A to 1D are diagrams illustrating the degree of gloss and the haze.

As shown in FIG. 1A, values of the degree of gloss and the haze can be determined by using a detector (for example, B-4632 (Japanese name: Micro-haze Plus) manufactured by BYK-Gardner) to detect light reflected by the surface of a print (a printed material). The reflected light is distributed through a certain angle around the axis of regularly reflected light. As shown in FIG. 1D, the degree of gloss is detected, for example, over an opening width of 1.8° around the center of the detector, and the haze is detected within ±2.7° from the range of the degree of gloss.

That is, when reflected light is observed, the degree of gloss is defined to be the reflectivity with respect to the incident light of the regularly reflected light, constituting the central axis of the distribution of the reflected light. The larger the degree of gloss is, the stronger impression of gloss the observer has. Further, the haze or a haze value is defined to be a measurement of light scattering near the regularly reflected light within the distribution of the reflected light. Even with a high degree of gloss, if the haze value is large, the image is observed to be white and cloudy.

Each unit of the degree of gloss and the haze measured by the detector has no dimension. The unit of the degree of gloss is in conformity with the K5600 of the JIS standard. The unit of the haze is in conformity with the DIS13803 of the ISO standard.

FIGS. 1B and 1C show that the amount of regularly reflected light varies depending on the roughness of the surface of a printing medium. As shown in these figures, the amount of regularly reflected light generally decreases with increasing surface roughness. Correspondingly, the measured degree of gloss decreases. Further, the haze value is not always correlated with the degree of gloss. Basically, even with the same degree of gloss, the haze value varies depending on the conditions of the surface.

Figure 2:
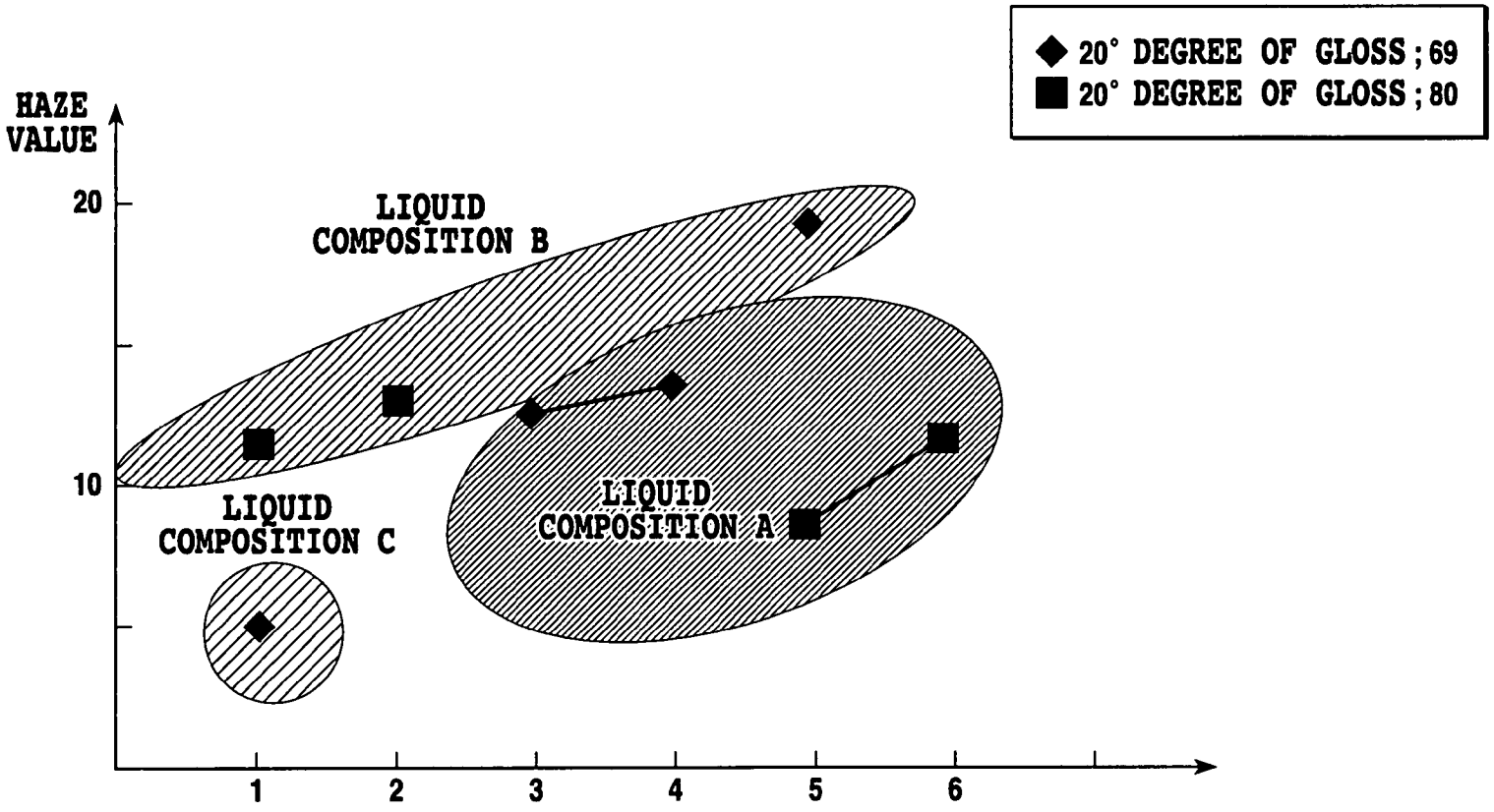
FIG. 2 is a graph showing the relationship between the degree of gloss and the haze.

FIG. 2 shows an example of the relationship between the degree of gloss and the haze described above. This figure shows the relationship between the degree of gloss, which was measured to be 69 and 80 at a measured angle of 20,° and the haze value, for different liquid compositions A, B, and C. Specifically, the axis of ordinate indicates the haze value. Further, the axis of abscissa indicates different liquid composition applying methods, described below in the embodiments. This figure shows the degree of gloss and haze for the six types of applying methods. The liquid compositions have different in compositions or the like.

As is apparent from FIG. 2, if for example, one fixed type of liquid composition is used as described below in the embodiments, either the degree of gloss or the haze can be varied by using the different liquid composition applying methods. For example, when the liquid composition A is used, the degree of gloss of 69 can be realized using the applying methods 3 and 4. Further, the degree of gloss of 80 can be realized using the applying methods 5 and 6. FIG. 2 also indicates that the haze value varies depending on the liquid composition applying method (the methods 3 and 4 or 5 and 6) in any of cases that the degree of gloss are 69 and 80.

The embodiments of the present invention relate to a print producing apparatus in the form of an ink jet printer. This print producing apparatus ejects ink to form and print an image and then ejects the liquid composition to the printed image to form an insolubilized layer to provide the image with gloss. Then, by using the different liquid composition applying methods as stated above, the degree of gloss and haze can be varied among multiple levels by controlling the conditions of the surface of the printed image. It is thus possible to express the various expressions of gloss of the print image and associated cloudiness. Specifically, a head having the same structure as that of an ink jet head is used to eject a liquid that is solidified or insolubilized on the printing medium as a result of reaction (this liquid is referred to as the "liquid composition" in this specification). Then, the manner of combining droplets of the liquid composition landing on the printing medium is controlled so as to determine the conditions for the irregularity of a layer formed when these droplets are insolubilized.

In some embodiments, the applying method may of course be set so that only the degree of gloss is varied with the haze value fixed.

Figure 3:
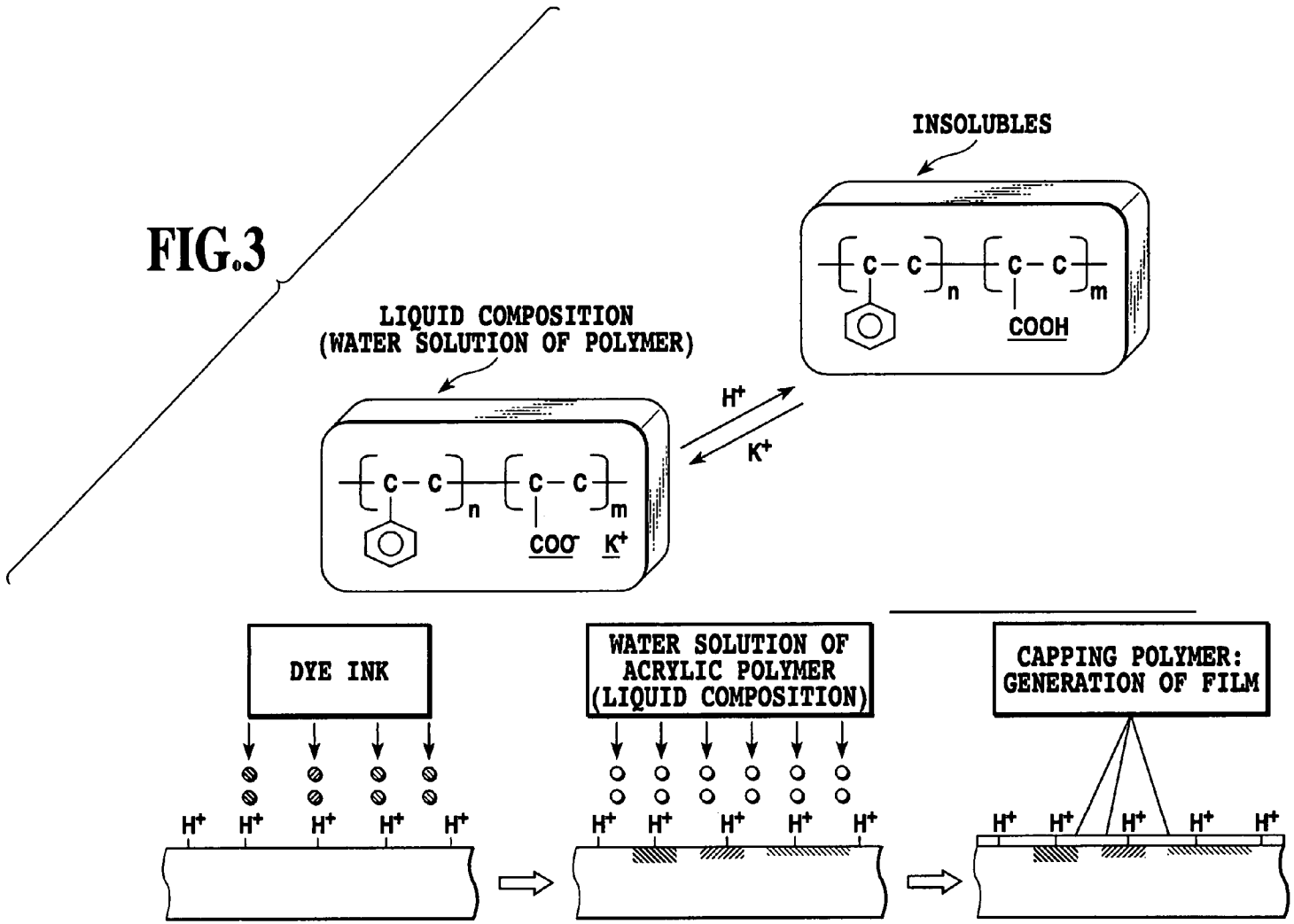
FIG. 3 is a view illustrating the mechanism of reaction resulting in the solidification of a liquid composition used in embodiments of the present invention.

FIG. 3 is a diagram illustrating the mechanism of the reaction resulting in the solidification of the liquid composition.

The liquid composition used in the embodiments of the present invention contains an aqueous medium and a polymer having the structure (hereinafter referred to as "carboxylate") formulated by the general formula shown below. Reaction occurs on the surface of a printing medium having such a surface pH as insolubilizes the polymer in the liquid composition, to form an insolubilized polymer layer.

As shown in FIG. 3, the liquid composition is composed of, for example, a water solution of styrene-acrylic polymer. This solution is ejected onto the printing medium (having such a surface pH as insolubilizes the polymer) on which an image has been printed using dye ink. Then, the pH of the surface of the printing medium contributes to generate a layer (a coat) of insolubles of the polymer on the printing medium. At this time, the present embodiment controls the level of integration of droplets formed by the liquid composition ejected and landing on the printing medium, to determine the surface shape of the layer finally formed by the insolubilized droplets. Then, the degree of gloss and the haze are obtained in accordance with the refection characteristics of the surface shape, as described in FIG. 1A.

Formula—COOA

In this formula, "A" denotes alkali metal, amine, or organic amine.

Now, a specific description will be given of the liquid composition, the printing medium, and the ink which can be used in the embodiments of the present invention.

First, the liquid composition that can be used in the embodiments of the present invention contains at least a polymer having carboxylate as described above. The surface pH of the printing medium acts to insolubilize instantaneously the polymer in the liquid composition to separate the polymer from the liquid composition. Thus, the printing medium absorbs only the solvent component to form a coat layer of insolubles on it.

The thickness of the coat layer formed on the printing medium is determined by the amount of polymer in the liquid composition and an ejection amount per unit area. The range of the thickness of the coat layer is preferably from 50 to 1,000 nm, and more preferably from 50 to 500 nm. If the thickness of the coat layer exceeds this range, it is necessary to increase the concentration of the solid portion of the polymer in the liquid composition, described later. Further, if the thickness of the coat layer is below this range, a gas barrier property may be insufficient, thus hindering the preservation of the image. The thickness of the coat layer can be measured by observing the cross section of a print using a scanning electron microscope.

The polymer contained in the liquid component and having carboxylate has only to dissolve in the liquid component and to be insolubilized under the action of the surface pH of the image to form a stable layer. For example, this polymer is preferably obtained by solubilizing, by the addition of a basic substance, a vinyl copolymer obtained by using one or more of acrylic acid, methacrylic acid, maleic acid, a half ester of maleic acid, and an acrylic acid monomer such as itaconic acid.

The basic substance includes, without any limitations, hydroxides of alkali metal such as lithium hydroxide, sodium hydroxide, and potassium hydroxide, an ammonia solution in water, monoethanol amine, diethanol amine, triethanol amine, monoisopanol amine, diisopnopanol amine, triisopropanol amine, morpholine, aminomethylpropanol, aminomethylpropanediol, and aminoethylpropanediol.

The monomer that can be copolymerized with the acrylic acid monomer is not particularly limited provided that it can be formed into a polymer having desired characteristics. It is possible to use, for example, at least one of the monomers including acrylate (methacrylate) monomers such as methyl acrylate (methacrylate), ethyl acrylate (methacrylate), isopropyl acrylate (methacrylate), n-butyl acrylate (methacrylate), isobutyl acrylate (methacrylate), n-amyl acrylate (methacrylate), isoamyl acrylate (methacrylate), n-hexyl acrylate (methacrylate), 2-ethylhexyl acrylate (methacrylate), n-octyl acrylate (methacrylate), decylactylate (methacrylate), and dodecyl acrylate (methacrylate), and a styrene monomer, benzil acrylate (methacrylate), 2-anthryl acrylate (methacrylate), 2-(benzoyloxy) ethyl acrylate (methoacrylate), 2-(5-ethyl-2-pyridyl) ethyl acrylate (methacrylate), [1, 1'-biphenyl]-4-yl acrylate (methacrylate), 7-oxo-1,3,5-cycloheptatriene-1-yl acrylate (methacrylate), 8-quinolyl acrylate (methacrylate), cyclohexyl acrylate (methacrylate), cyclododecyl acrylate (methoacrylate), 1-methylnexyl acrylate (methoacrylate), 1-methylheptyl acrylate (methacrylate), 2-ethylpentyl acrylate (methacrylate), 1-cyclohexyl-3-azetidinyl acrylate (methoacrylate), 9-carbazolylmethyl acrylate (methacrylate), tetrahydro-2H-pyran-2-yl acrylate, 3-nitrophenyl acrylate (methacrylate), 1-(3-perylenyl)ethyl acrylate (methacrylate), and (3-methyloxiranyl) acrylate (methoacrylate). At least one of these monomer may be selected and used.

The paired ion (denoted by A in the formula) in the present invention includes alkali metal, amine, and organic amine. At least one of them may be selected and used.

The alkali metal includes, for example, lithium, sodium, potassium, and rubidium. The organic amine includes alkylamines and alkanolamines such as monoethanolamine, diethanolamine, triethanolamine, monoisopropanolamine, diisopropanolamine, triisopropanolamine, monomethylamine, diethylamine, and triethylamine.

In the present invention, the acid value of the polymer may be properly selected to vary depending on the pH or conditions of the surface of the printing medium, described later, and on the types of the monomers constituting the polymer and so that the polymer is insolubilized on the printing medium. Specifically, the content of carboxylate is adjusted so that when a water solution of the polymer having carboxylate is dropped onto a water solution with a pH corresponding to the surface pH of the printing medium, the polymer is insolubilized and separated from the solution.

The acid value of the polymer is preferably between 50 and 300. If the acid value is less than 50, the polymer may not be fixed appropriately. Further, if a thermal ink jet method is used, the polymer may be burned and stuck to a heater to prevent stable ejection. On the other hand, if the acid value exceeds 300, the polymer is not insolubilized on the sheet. It is thus necessary to increase excessively the concentration of polyvalent metal ions in an ink receiving layer in the printing medium in order to form a coat layer. This may adversely affect the tint of the image. In this regard, the acid value is based on a value measured by a method in conformity with the JIS K0070. Further, the pH of the liquid composition according to the present invention is adjusted on the basis of the amount of basic substance added or using a PH controlling agent. The pH of the liquid composition is such that the polymer having carboxylate is insolubilized. The pH of the liquid composition is preferably between 5.4 and 11.0, more preferably between 6.0 and 11.0. If the pH of the liquid composition exceeds 11.0, a member such as the head which contacts with the liquid composition may not be durable. If the pH of the liquid composition is less than 5.4, the surface pH of the printing medium must be adjusted to 5.4 or less and the tint of the image maybe degraded, as described later.

The molecular weight of the polymer having carboxylate according to the present invention is not particularly limited. For example, the polymer has a weighted mean molecular weight of 1,000 to 100,000, preferably 1,000 to 50,000 before the basic substance is added. If the weighted mean molecular weight exceeds 100,000, the liquid composition may become viscous to hinder ink from being stably ejected using the ink jet printing method. On the other hand, if the weighted mean molecular weight is less than 1,000, the coat layer may not have a sufficient gas barrier property. Here, the weighted mean molecular weight is represented using a THF/DMF-mixed-solvent-based polystyrern conversion value on the basis of GPC (Gel Permiation Chromatography).

Further, the content, in the liquid composition, of the polymer having carboxylate is preferably 1.0 to 15 wt %, more preferably 1 to 6 wt % of the total amount of liquid composition. If the content of the polymer in the liquid composition exceeds 15 wt %, the liquid composition may become viscous to hinder ink from being stably ejected using the ink jet printing method. On the other hand, if the content of the polymer in the liquid composition is less than 1 wt %, the coat layer may not have a sufficient gas barrier property.

The solvent used for the liquid composition used to form a coat layer according to the present invention is water or a mixed solvent of water and a water-soluble organic solvent. A particularly suitable solvent is the mixed solvent of water and a water-soluble organic solvent containing polyvalent alcohol that can prevent the liquid composition from being dried. Further, preferable water is not common water containing various ions but is deionized water.

The water-soluble organic solvent mixed with water includes, for example, alkyl alcohols with a carbon number of 1 to 4 such as methyl alcohol, ethyl alcohol, n-propyl alcohol, isopropyl alcohol, n-butyl alcohol, sec-butyl alcohol, tert-butyl alcohol, isobutyl alcohol; amides such as diemthylformamide and dimethylacetoamide; ketones or ketoalcohols such as acetone and diacetone alcohol; ethers such as tetrahydrofuran and dioxane; polyalkylene glycols such as polyethylene glycol and polypropylene glycol; alkylene glycols with an alkylene group containing two to six carbon atoms, such as ethylene glycol, propylene glycol, butylenes glycol, triethylene glycol, 1,2,6-hexanetriol, thiodiglycol, hexylene glycol, and diethylene glycol; glycerin; lower alkyl ethers of polyalcohols such as ethylene glycol methyl (or ethyl) ether, diethylene glycol methyl (or ethyl) ether, triethylene glycol monomethyl (or monoethyl) ether; and N-methyl-2-pyrrolidone and 1,3-dimethyl-2-imidazolidinone.

Among these many water-soluble organic solvents, polyalcohols such as diethylene glycol and lower alkyl ethers of polyalcohols such as triethylene glycol monomethyl (or monoethyl) ether are preferable.

The content of the water-soluble organic solvent in the liquid composition is 0 to 95%, preferably 10 to 80%, more preferably 20 to 50% of the total weight of the liquid composition. Further, the content of water may be properly selected from the range from 40 to 99%, more preferably 50 to 95% of the total mass of the liquid composition.

Further, the liquid composition used in the present invention may contain a surface-active agent, a viscosity control agent, a surface tension control agent, a pH control agent, a mildewproofing agent, or an anticorrosive agent. Furthermore, the liquid composition according to the present invention may contain a color material for decoration (addition of a logo using light blue or the like) or the like.

Now, description will be given of the printing medium used in the present invention.

In the embodiments of the present invention, the polymer contained in the liquid composition and used to form a coat layer is separated from the liquid on the printing medium as described previously. Accordingly, the surface pH of the printing medium must be controlled to such a value as enables the polymer in the liquid composition to be insolubilized. The surface pH appropriate for insolubilization may be properly selected in accordance with the polymer used for the liquid composition. A preferable range of the surface pH is from 5.4 to 7.0. If the surface pH exceeds this range, the acid value of the polymer must be reduced in order to separate the polymer from the liquid composition on the printing medium. Consequently, ejection is not carried out sufficiently stably. On the other hand, if the surface pH is below this range, the tint or light resistance of the printed image may be degraded. Furthermore, the ability to absorb a print liquid (dye ink) may be degraded.

To adjust the surface pH of the printing medium, an acid water solution such as nitric acid, hydrochloric acid, or sulfuric acid or an alkali water solution such as ammonia may be coated on a printing medium so as to obtain a desired surface pH, the printing medium being already produced by a well-known method and having a predetermined surface pH. Alternatively, a coating liquid used to form an ink receiving layer may have its pH adjusted to a desired value before being coated and dried on a base material to form an ink receiving layer. In this regard, the surface pH is measured in conformity with the JAPAN TAPPI No. 49-2 (coating method).

The printing medium used in the embodiments of the present invention is suitably composed of a porous ink receiving layer provided on the base material and mainly consisting of a pigment.

The base material is not particularly limited and may be paper such as properly sized paper, unsized paper, or resin coated paper, a sheet-like substance such as a resin film, or a cloth. In particular, if the base material is composed of properly sized paper or unsized paper, the same surface pH as that of the printed medium, described later, is preferably used to achieve stability.

The ink receiving layer of the printing medium according to the present invention is preferably formed to have a pore volume of 0.35 to 1.0 ml/g, more preferably 0.4 to 0.9 ml/g. If the pore volume of the ink receiving layer exceeds this range, (the ink receiving layer may be cracked). If the pore volume of the ink receiving layer is below this range, ink cannot be absorbed appropriately, and in particular, if multicolor printing is carried out, ink may overflow from the ink receiving layer to blur the image.

Further, the ink receiving layer preferably has a BET specific surface area of 50 to 300 $m^2/g$, more preferably 100 to 300 $m^2/g$. If the BET specific surface area is below this area, the ink receiving layer is not glossy and an increase in haze value may make the image appear white and hazy. On the other hand, if the BET specific surface area is above this range, the ink receiving layer may be cracked.

The BET specific surface area and the pore volume can be determined by a nitrogen adsorption and desorption method after a deaerating process at 120° C. for 24 hours.

The material for the ink receiving layer exhibiting the above physical properties is not particularly limited. A preferable example of an alumina hydrate formulated by the following general formula:

$$Al_2O_{3-n}(OH)_{2n}.mH_2O$$

where n denotes one of the integers 0, 1, 2, and 3, m denotes a value between 0 and 10, preferably between 0 and 5. Since $mH_2O$ often represents a desorptible aqueous phase not involved in the formation of a crystal lattice, m can take a value that is not an integer. Further, when an alumina hydrate of this kind is calcined, the value of m may reach zero. However, both m and n do not simultaneously take a value of zero.

The alumina hydrate has its pore physical properties adjusted during a producing process. To achieve the BET specific surface area and pore volume of the ink receiving layer, the alumina hydrate preferably has a pore volume of 0.3 to 1.0 ml/g, more preferably 0.35 to 0.9 ml/g. An alumina hydrate having the pore volume within this range is suitably used to determine the pore volume of the ink receiving layer within the above specified range. For the BET specific area, the alumina hydrate of the area of 50 to 350 $m^2/g$ is preferably used and that of the area of 100 to 250 $m^2/g$ is more preferably used. An alumina hydrate having the BET specific area within this range is suitably used to determine the BET specific area of the ink receiving layer within the above specified range.

The amount of dispersant coated is between 0.5 and 60 $g/cm^2$, more preferably between 5 and 45 $g/m^2$ in dry solid equivalent. To obtain a high ink absorptivity and a high resolution, the ink receiving layer has a thickness of, for example, 15 to 60 μm, preferably 20 to 55 μm, particularly preferably 25 to 50 μm.

In the above description, the printing medium is basically acid, i.e. contains hydrogen ions. However, the present invention is not limited to the acid printing medium. For example, in a preferred embodiment, the ink receiving layer may contain polyvalent metal ions of such a concentration as insolubilizes the polymer so that the metal ions can react with the liquid composition to generate insolubles of the polymer. Specifically, in the printing medium, the concentration of polyvalent metal ions in the ink receiving layer is controlled to such a value as insolubilizes the polymer in the liquid composition. The concentration of polyvalent metal ions in the ink receiving layer of the printing medium may be properly selected in accordance with the polymer used in the liquid composition. The concentration of polyvalent metal ions in the ink receiving layer is preferably from 0.01 to 1.0 (mol/L), more preferably from 0.04 to 0.8 (mol/L). If the concentration of polyvalent metal ions in the ink receiving layer is less than 0.01 mol/L, the acid value of the polymer must be reduced in order to insolubilize the polymer in the liquid composition on the printing medium. Consequently, ejection is not carried out sufficiently stably. On the other hand, if the concentration of polyvalent metal ions in the ink receiving layer exceeds 1.0 mol/L, the tint or light resistance of the printed image may be degraded. Furthermore, the ability to absorb a print liquid (dye ink) may be degraded.

In the present embodiment, the concentration of polyvalent metal ions in the ink receiving layer is determined using the following equation:

$$\text{Concentration of polyvalent metal ions (mol/L)} = \frac{W}{V_p}$$

where W and $V_p$ denote the concentration (mmol/g) of polyvalent metal ions per 1 g of ink receiving layer and a void volume (mL/g) in 1 g of ink receiving layer.

The value W can be measured using a fluorescent X ray measuring apparatus after the ink receiving layer has been removed from the printing medium as required. Further, the value $V_p$ is determined using the equation $V_p = V_1/H_1 - D_1$, comprising the volume ($V_1$(ml/$m^2$)) of the ink receiving layer per unit area on the printing medium and the real density ($D_1$/ml/g)) of the ink receiving layer. The real density of the ink receiving layer can be measured using, for example, a dry automatic densimeter (manufactured by Shimadzu Corporation; Accupyc 1330) after the ink receiving layer has been removed from the printing medium as required.

In the embodiments of the present invention, the polyvalent metal ions contained in the ink receiving layer may be composed of alkali earth metal such as magnesium or calcium, rare earth metal such as yttrium, lanthanum, or cerium, or transition metal such as zirconium. The polyvalent metal ions have only to insolubilize the polymer in the liquid composition, which is used to form a coat layer. At least one of these types of polyvalent metal ions may be used.

To add the polyvalent metal ions to the ink receiving layer, a water solution of water-soluble polyvalent metal salt is coated on a produced print so as to obtain a desired concentration of polyvalent metal ions. Alternatively, metal salt is added to a coating liquid used to form a ink receiving layer, so as to obtain a desired concentration of polyvalent metal ions, before coating and drying the coating liquid on the base material to form an ink receiving layer.

Further, the printing medium desirably has absorbs the liquid composition so that the liquid composition ejected from the head and impacting the printing medium is insolubilized while maintaining a specified droplet form. For example, it is not preferable that the printing medium absorbs the liquid composition so poorly that the liquid composition spreads over the printing medium immediately after impacting.

Now, description will be given of ink as a printing liquid that can be used in the embodiments of the present invention.

In the embodiments of the present invention, the components of color materials contained in ink are well known and include water-soluble dyes typified by, for example, a direct dye, an acid dye, a basic dye, a reactive dye, and a food pigment. Such a water-soluble dye generally takes up about 0.1 to 20 wt % of the total amount of the ink.

The solvent used for the ink is water or a mixture of water and a water-soluble organic solvent. Suitable solvents have already been cited as the examples of the liquid composition used to form a coat layer. The content of the water-soluble organic solvent in the ink is generally 0 to 95%, preferably 10 to 80%, more preferably 20 to 50% of the total weight of the ink.

Further, in addition to the above components, the ink may contain a surface-active agent, a viscosity control agent, a surface tension control agent, a pH control agent, a mildew-proofing agent, or an anticorrosive agent.

Figure 4A:
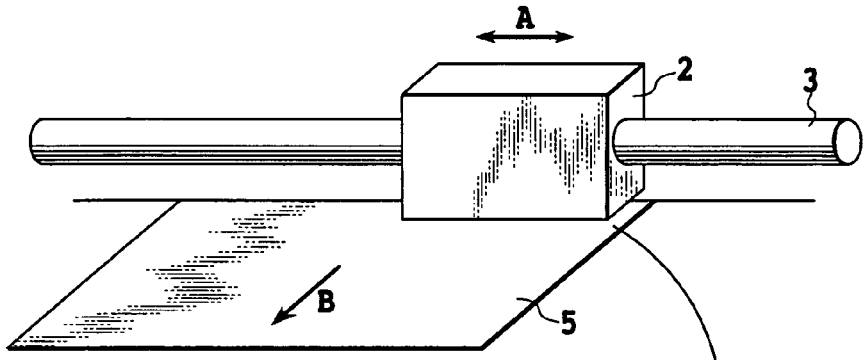
FIGS. 4A and 4B are views schematically showing a configuration of an ink jet printer as a print producing apparatus according to the embodiments of the present invention.
Figure 4B:
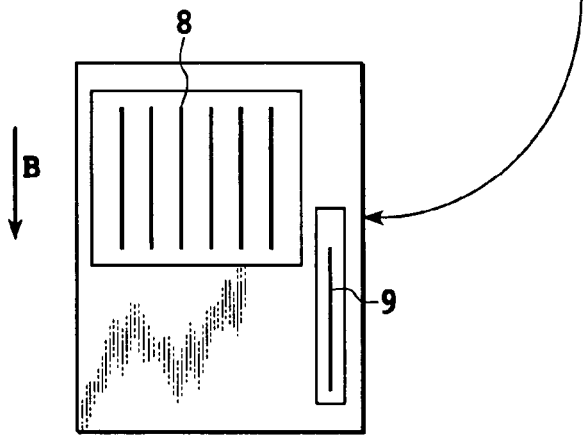

FIGS. 4A and 4B are views schematically showing a configuration of an ink jet printer as a print producing apparatus according to the embodiments of the present invention.

The printer shown in FIG. 4A is of what is called a "serial type". A carriage 2 is mounted with respective tanks storing ink and the above liquid composition and respective heads used to eject the ink and liquid composition. While being guided along a shaft 3, the carriage 2 is moved by a driving mechanism (not shown) in the direction of an arrow A in the figure to allow each head to scan. During the scan, a relevant head ejects the ink or liquid composition to a printing medium 5 such as a sheet, which has been previously described. Further, after the scan, the printing medium 5 is conveyed by a predetermined amount in the direction of an arrow B in the figure. By repeating the scan and the conveyance of the printing medium, for example, one page of the printing medium is printed on the basis of print data. The present embodiment uses six types of ink, i.e. yellow ink (Y), magenta ink (M), cyan ink (C), black ink (K), and light magenta (LM) and light cyan ink (LC), which have lower dye concentrations than the magenta ink and cyan ink, respectively. Thus, six ink tanks and six heads are used in association with these ink types. One type of liquid composition is used, so that one liquid composition tank and a corresponding head are used.

FIG. 4B is a schematic view of the heads mounted on the carriage 2 as viewed from the printing medium. This figure shows an integral structure in which the six heads and the liquid composition head are connected together using predetermined members. However, of course, the present invention is not limited to this aspect. The heads may be individually detachable from the carriage.

In FIG. 4B, the six lines shown by reference numeral 8 represent rows of ink ejection openings in the respective heads. Each row is formed of, for example, 256 ejection openings. On the other hand, the liquid composition head comprises an ejection opening row 9 composed of 256 ejection openings like the ink head. The liquid composition head is provided offset from the six ink heads in the conveying direction B.

In the present embodiment, the amount of offset equals to one pitch of the ejection opening arrangement in each ejection opening row. That is, in this figure, there is a distance equal to one pitch between the ejection opening at the lowermost end of the ejection opening row in each ink head and the ejection opening at the uppermost end of the ejection opening row in the liquid composition head. On the other hand, the printer according to the present embodiment can execute multi-pass printing up to four passes using each ink head. With the multi-pass printing, for example, in the case of four passes, the ejection opening row in each ink head is divided into four pieces and each of the four pieces of the ejection openings is used for each scan area of a width equal to one piece to complete printing. A printing operation is performed by repeating the conveyance of the printing medium by an amount equal to the above width and the scan of the ink head. With this multi-pass printing, each line (raster) of ink dots in a scanning direction which correspond to each ejection opening is formed by ink ejected from the different ejection openings during a plurality of scans. Thus, when a certain image is printed, data used for one of the plurality of scans is complementary to data used for the other scan. For example, with 4-pass printing, four divided data are complementary to one another. These data are commonly generated by a mask process.

In the embodiments of the present invention, the liquid composition head performs an operation similar to the ink heads in 1-pass printing or 2- or 4-pass printing, as described later in FIGS. 5B to 5D and succeeding figures. The liquid composition head thus ejects the liquid composition to the printing medium to form an insolubilized layer of the polymer. For example, during a 4-pass operation, the liquid composition head operates in exactly the same manner as the ink heads do. As the printing medium 5 is conveyed by an amount equal to the above width corresponding to one of the four pieces, the four pieces of the ejection opening row 9 are sequentially aligned with the corresponding areas each having the above width. Thus, the liquid composition is ejected to complete a layer in each area. On the other hand, for 1-pass, for example, all the ejection openings in the ejection opening row 9 are used to eject the liquid composition during one scan operation, which operation enables all the four divided areas to be scanned at once, among scan operations for 4-pass printing with the ink heads. Thus, layers are formed in these areas. For a 2-pass operation, for example, half the ejection openings in the ejection opening row 9 are used to eject the liquid composition during one scan operation, which operation enables two of the four divided areas to be scanned at once, among four scan operations for 4-pass printing with the ink head, and then, half the ejection openings in the ejection opening row 9 are differentiated for ejecting the liquid composition to form the layers for the four divided areas.

With the ink heads and the liquid composition head according to the embodiments of the present invention, thermal energy generated by an ejection heater is utilized to generate a bubble in the ink and in the liquid composition respectively. Then, the pressure of the bubble causes the ink and the liquid composition to be ejected from the ejection openings. However, the ejecting method is not limited to this aspect. It is possible to use any method such as a piezoelectric method which enables the liquid composition to be applied to the printing medium as droplets.

Further, in general, a host apparatus such as a personal computer generates data on the ink and liquid composition and transfers it to a printer. The printer then performs printing operation according to the respective embodiments, described in FIG. 5A and succeeding figures. In this case, a printer itself which receives data and operates on the basis of data, and a system including a printer and the host apparatus which generates and transfers data to cooperate with the printer, are respectively one form of the print producing apparatus in virtue of that each of the printer and the system has at least an arrangement for performing the printing operations according to the respective embodiments. Further, the form of the print producing apparatus also includes an apparatus that produces a final print with the degree of gloss and the like adjusted, by controlling the gloss and the like by carrying out only the formation of an insolubilized layer on a printing medium on which an image has already been printed, the formation being included in the printing operations according to the respective embodiments. For example, one form of the print producing apparatus comprises only the liquid composition head and ejects the liquid composition as described later in FIG. 5A and other figures. In another form of the print producing apparatus, a printing apparatus such as a printer does not receive print data and liquid composition data from the host apparatus but a memory medium is installed in the printing apparatus to input print data directly to it. The printing apparatus then carries out the generation of liquid composition data and the like on the basis of the print data and performs the printing operations according to the respective embodiments. In this case, of course, the above processing is executed by a data processing and controlling configuration of the printing apparatus which has a CPU and the like.

(First Embodiment)

The above described liquid composition used in the respective embodiments of the present invention is insolubilized in a relatively short time owing to the acid of the printing medium, after the liquid lands on a printing medium. With the printer according to the embodiments of the present invention, shown in FIGS. 4A and 4B, droplets of the liquid composition ejected during one scan of the liquid composition head are contacted to be completely integrated on the printing medium. The liquid composition is then insolubilized to form an almost flat layer. In other words, in the embodiments of the present invention, the liquid composition ejected during the preceding scan starts to be insolubilized earlier than the subsequently ejected liquid composition because of a time difference. Thus, even if these liquid compositions contact with each other, the level of integration is low. Consequently, the liquid compositions are not completely integrated but are insolubilized while maintaining the shapes of the droplets to some degree. In the embodiments of the present invention, the level of integration of droplets of the liquid composition is controlled to determine the conditions of the surface of a layer formed by the droplets. This allows the control of the degree of gloss and the haze of the printed image.

With the above mechanism for controlling the degree of gloss and the haze, the sizes of droplets of the liquid composition applied to the printing medium through ejection are a factor in determining the shapes of the droplets (radius of curvature and the like). Consequently, it is a factor in determining the degree of gloss and haze. Accordingly, for each system such as an apparatus, the ejection resolution and ejection amount of the liquid composition are properly determined in order to obtain a desired set degree of gloss and haze. In the present embodiment, the resolution is 1,200 dpi and the ejection amount is 4.45 ng. The degree of gloss and haze shown below are realized on the basis of the sizes of droplets based on the resolution and the ejection amount.

Figure 5A:
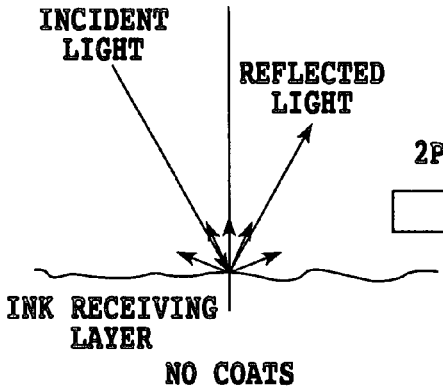
FIGS. 5A to 5D are schematic diagrams showing insolubilized layers and reflected light resulting from the ejection of the liquid composition during a 1-pass operation or a multi-pass operation, i.e. a 2- or 4-pass operation.
Figure 5B:
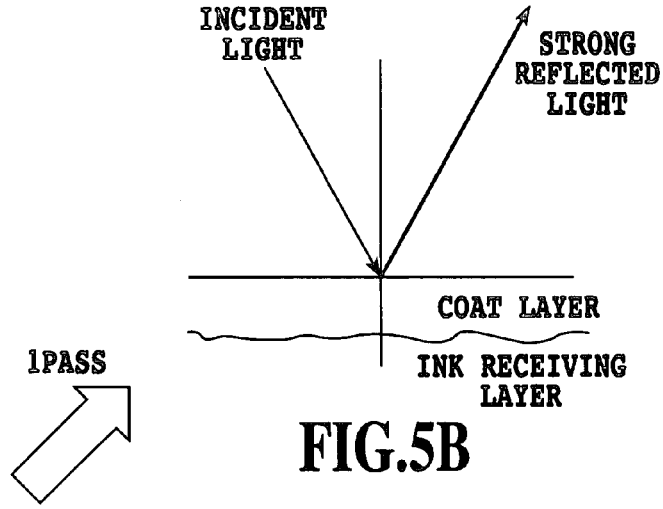
Figure 5C:
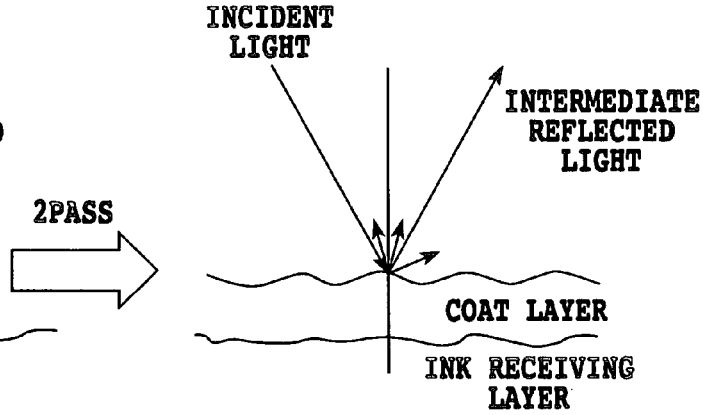
Figure 5D:
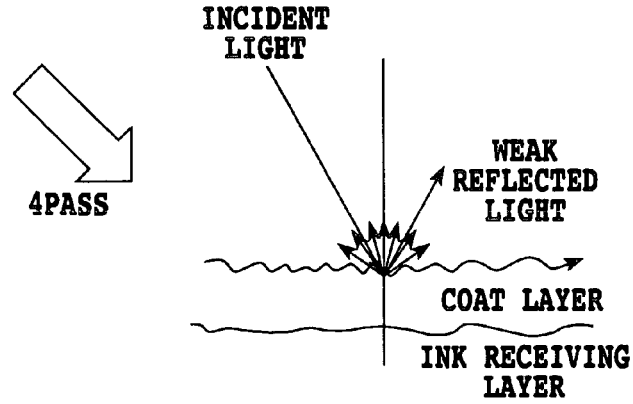

FIGS. 5B to 5D are diagrams illustrating a method of applying the liquid composition. These figures schematically show insolubilized layers (coat layers) and reflected lights in the cases of ejecting the liquid composition during a 1-pass operation or a multi-pass operation, i.e. a 2- or 4-pass operation, respectively. FIG. 5A shows the condition of the surface of the printing medium as well as the resultant reflection before the coat layer is formed. This figure indicates that the ink receiving layer, which constitutes the surface of the printing medium, has an irregular face, so that much irregular reflection occurs to reduce the degree of gloss.

In contrast, in the case that the coat layer is formed by a 1-pass operation, all the ejection openings in the ejection opening row 9 in the liquid composition head shown in FIGS. 4A and 4B are used to eject the liquid composition to an area of a certain size, in which a layer needs to be formed, at one scan operation. Thus, as shown in FIG. 5B, each of the droplets of the liquid composition landing on the printing medium during this one scan has an adjacent droplet of the liquid composition at the corresponding ejection position except for the contour part of the above area. This enables the droplets to be individually integrated with the adjacent droplets to form a flat coat layer. In connection with the term "integration" as used herein, the droplets are completely integrated when almost all the droplets lose their shapes on the printing medium and cannot be individually identified. In other words, the level of integration is determined according to the remaining shapes of the droplets.

The complete integration shown in FIG. 5B results in an almost flat surface condition and an increased amount of regularly reflected light. Therefore, the degree of gloss increases.

FIG. 5C shows that the liquid composition is ejected for forming the layer during a 2-pass operation. In this case, as described for FIG. 4B, the liquid composition is ejected to the area to which the liquid composition is to be ejected, during two scans on the basis of complementary data. Accordingly, no droplets may be present at ejection positions adjacent to the respective droplets landing on the printing medium during the first scan. Thus, for the liquid composition ejected during the first scan, the amount of connected droplets is smaller than that in the case of a 1-pass operation, though the difference varies depending on a mask pattern used. Accordingly, these droplets are not completely integrated but starts to be insolubilized before the second scan. Further, during the second scan, droplets are ejected to the positions to which the liquid component was not ejected during the first scan. However, as in the case with the first scan, these droplets are not completely integrated but are insolubilized. Thus, the individual ejected droplets are insolubilized while maintaining their original shapes to some degree. Consequently, the resultant coat layer has a surface with a large number of concaves and convexes. The surface with the large number of concaves and convexes serves to increase the amount of irregular reflection to reduce the amount of regularly reflected light. Consequently, the degree of gloss decreases. Further, the haze value depends on the surface conditions as described previously.

FIG. 5D shows the formation of a coat layer and the like in the case of a 4-pass operation. In this case, the coat layer has a surface with specific concaves and convexes or a specific roughness as in the case with a 2-pass operation. For a 4-pass operation, the amount of connected adjacent droplets of the liquid composition ejected during each scan is much smaller than that in the case of 2-passes operation. Thus, the amount of concaves and convexes and the amount of irregularly reflected light increase to reduce the degree of gloss. Further, the density of droplets landing on the printing medium during one scan decreases to facilitate the absorption of the solvent components and the evaporation of moisture at the level of droplets. Accordingly, the resultant layer maintains the shapes of droplets which are observed immediately after landing and which are much closer to a hemisphere. In this case, the haze value also depends on the surface conditions.

Further, when the density of droplets landing on the printing medium decreases to increase the speed of insolubilization as in the case with the 4-pass operation, the boundary between the droplets may be observed as a false interface inside the layer formed. This false interface increases the amount of light irregularly reflected from the surface of the layer. If such a false interface is observed, the degree of gloss further decreases.

As described above, the degree of gloss and the haze can be controlled by varying the number of passes for forming the layer to vary the surface conditions of the coat layer.

In the embodiments of the present invention, it is preferable that in addition to the variation in the number of passes, the cluster size of a mask used in the multi-pass operation is varied as an applying method for the liquid composition. This enables the precise control of the degree of gloss and the haze. More specifically, when only the number of passes is varied, the degree of gloss and the haze change at relatively large extent. This is effective in forming an image in which the impression of gloss varies significantly step by step. However, if the impression of gloss varies somewhat continuously, the degree of gloss and haze must be controlled more precisely. Thus, the cluster size of the mask is further varied so that droplets landing on the printing medium during one scan can be connected together in accordance with this size, and the number of droplets connected together is varied.

Figure 6A:
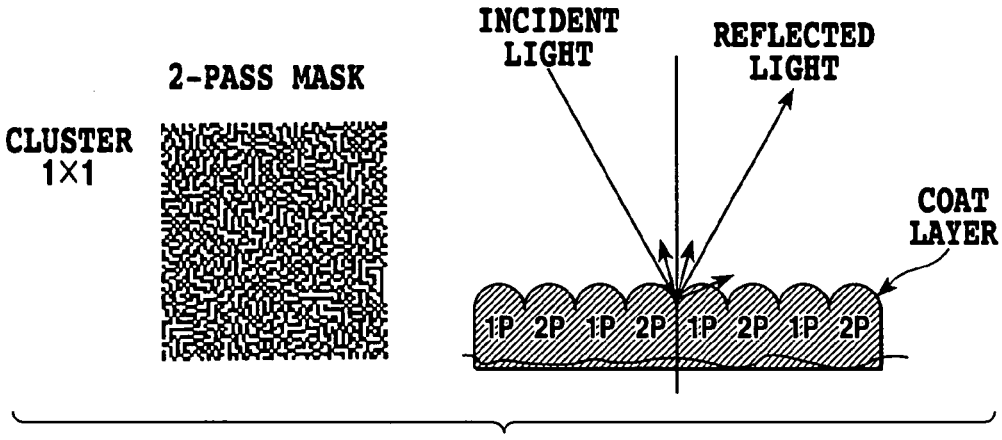
FIGS. 6A to 6C are diagrams illustrating a variation in the degree of gloss caused by a difference in the cluster size of a mask.
Figure 6B:
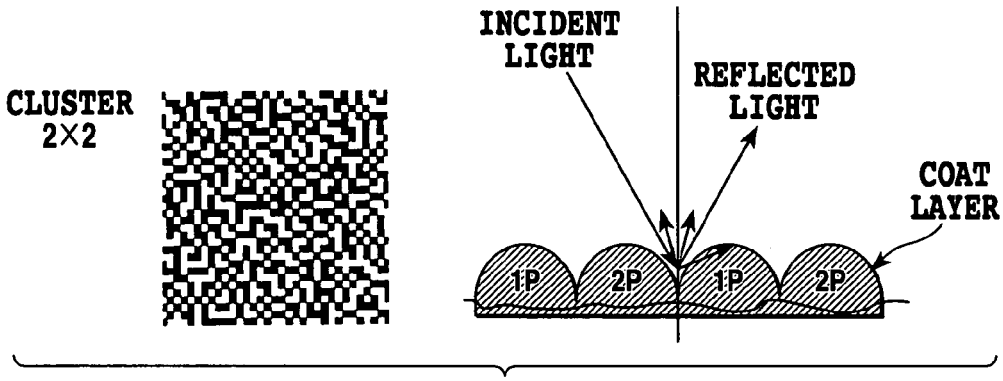
Figure 6C:
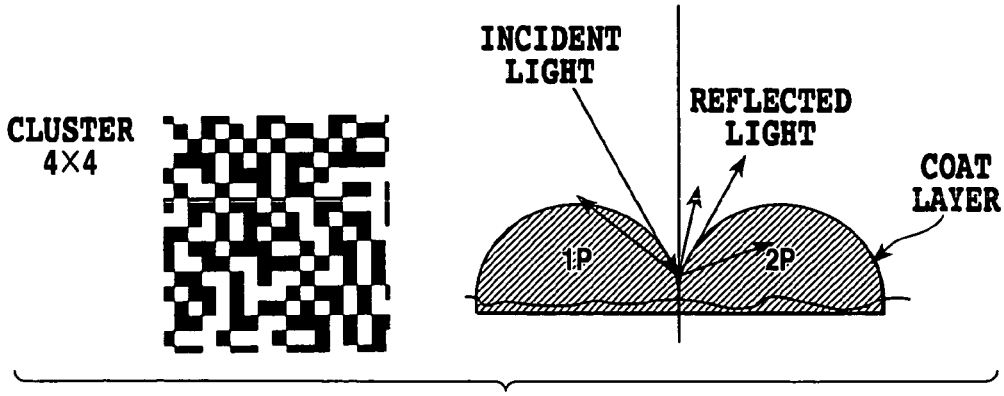

FIGS. 6A to 6C are diagrams illustrating that the degree of gloss varies depending on the cluster size of the mask. These figures show three examples in which the cluster sizes of the mask are varied in the case of the 2-pass operation described for FIG. 5C. Here, the cluster size of the mask is a size of a minimum unit for a mask process. The cluster size can be represented by the number of pixels with which one data or one ejected droplet is associated.

FIG. 6A shows a mask for a 2-pass operation which has a cluster size of 1×1. This figure schematically shows a mask pattern in its left part. This pattern is used for the first scan for forming the layer, and of course, a pattern for the second scan is complementary to the first pattern. This also applies to a pattern of cluster size 2×2 and a pattern of cluster size 4×4, shown in FIGS. 6B and 6C, respectively. Further, the mask patterns for two passes each have an ejection duty of 50%. The four mask patterns for the 4-pass operation are obtained as equally divided pattern similarly to the 2-pass operation so that each pattern has an ejection duty of 25%.

When the cluster size is 1×1, basically one droplet lands on the printing medium on the basis of ejection data on the liquid composition obtained using a mask process (certain mask patterns may cause several droplets to be connected together as shown in the pattern in the figure), thus, the droplets remaining after the insolubilization have shapes closer to that of one droplet.

On the other hand, FIGS. 6B and 6C show masks for a 2-pass operation which have cluster sizes of 2×2 and 4×4, respectively. In these cases, basically 4 and 16 droplets corresponding to 4 and 16 pixels, respectively, land on the printing medium and are then insolubilized into one droplet. Thus, the droplets remaining after the insolubilization are shaped like large concaves and convexes. The sizes of the concaves and convexes increase consistently with the cluster size. The amount of irregularly reflected light increases consistently with the sizes of the concaves and convexes. Consequently, the degree of gloss decreases. The haze value depends on the conditions of the concaves and convexes as described above.

In the embodiments of the present invention, the range of a variation in the degree of gloss or the haze caused by a variation in cluster size is designed to be smaller than that caused by a variation in the number of passes, described in FIGS. 5B to 5D.

Figure 7:
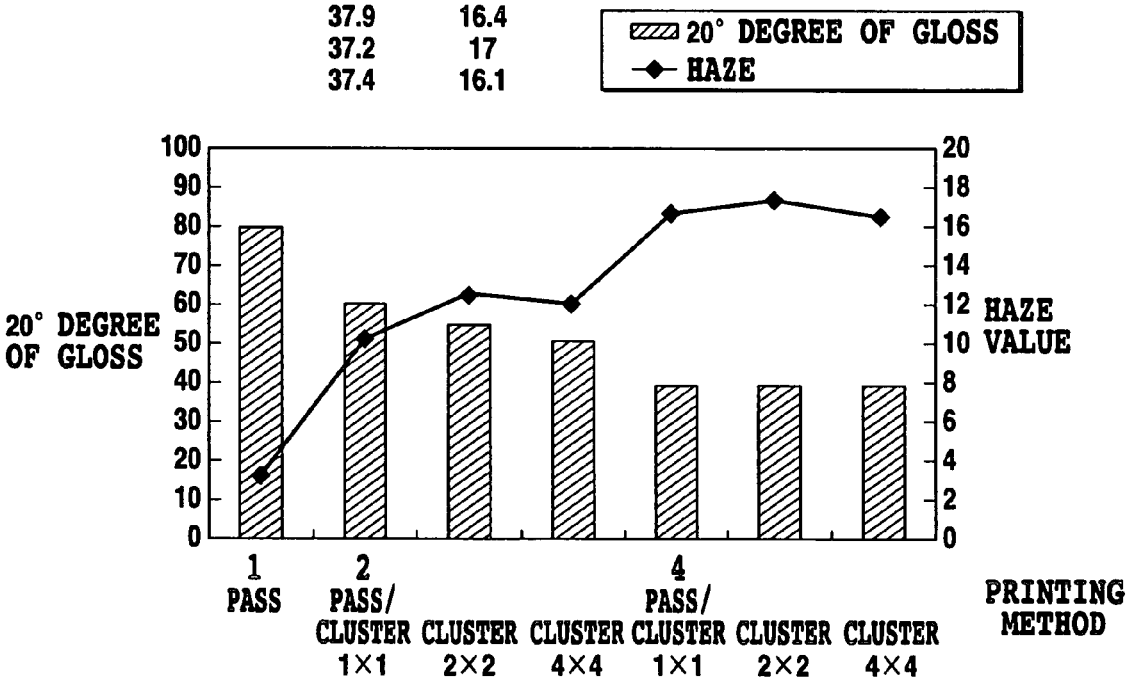
FIG. 7 is a graph showing the degree of gloss and haze varying among multiple levels depending on a combination of the number of passes and the cluster size of the mask used in the controlling the degree of gloss and haze according to a first embodiment of the present invention.

FIG. 7 shows the degree of gloss and the haze varied step by step in accordance with the combination of the number of passes and the cluster size of the mask used, in controlling the degree of gloss and the haze according to the first embodiment of the present invention. In the example shown in the figure, the degree of gloss is measured at an angle of 20°.

With the control according to the present embodiment, the degree of gloss decreases with increasing number of passes. Further, even with the same number of passes, the degree of gloss decreases with increasing cluster size. The haze value depends on the surface conditions. In other words, the numbers of passes and the cluster sizes which realize plural sets of the degree of gloss and haze used for the printing system of the present embodiment are previously examined. Then, these numbers of passes and cluster sizes are set as control parameters.

As shown in FIG. 7, in the present embodiment, seven combinations of the numbers of passes and the cluster sizes can be set including one pass, combinations of two passes with a cluster size of 1×1, 2×2, or 4×4, and combinations of four passes with a cluster size of 1×1, 2×2, or 4×4. For example, an insolubilized layer can be formed by ejecting the liquid composition for an image on the basis of information on the above combination set for each image data. This provides the printed image with the desired degree of gloss and haze.

Figure 8:
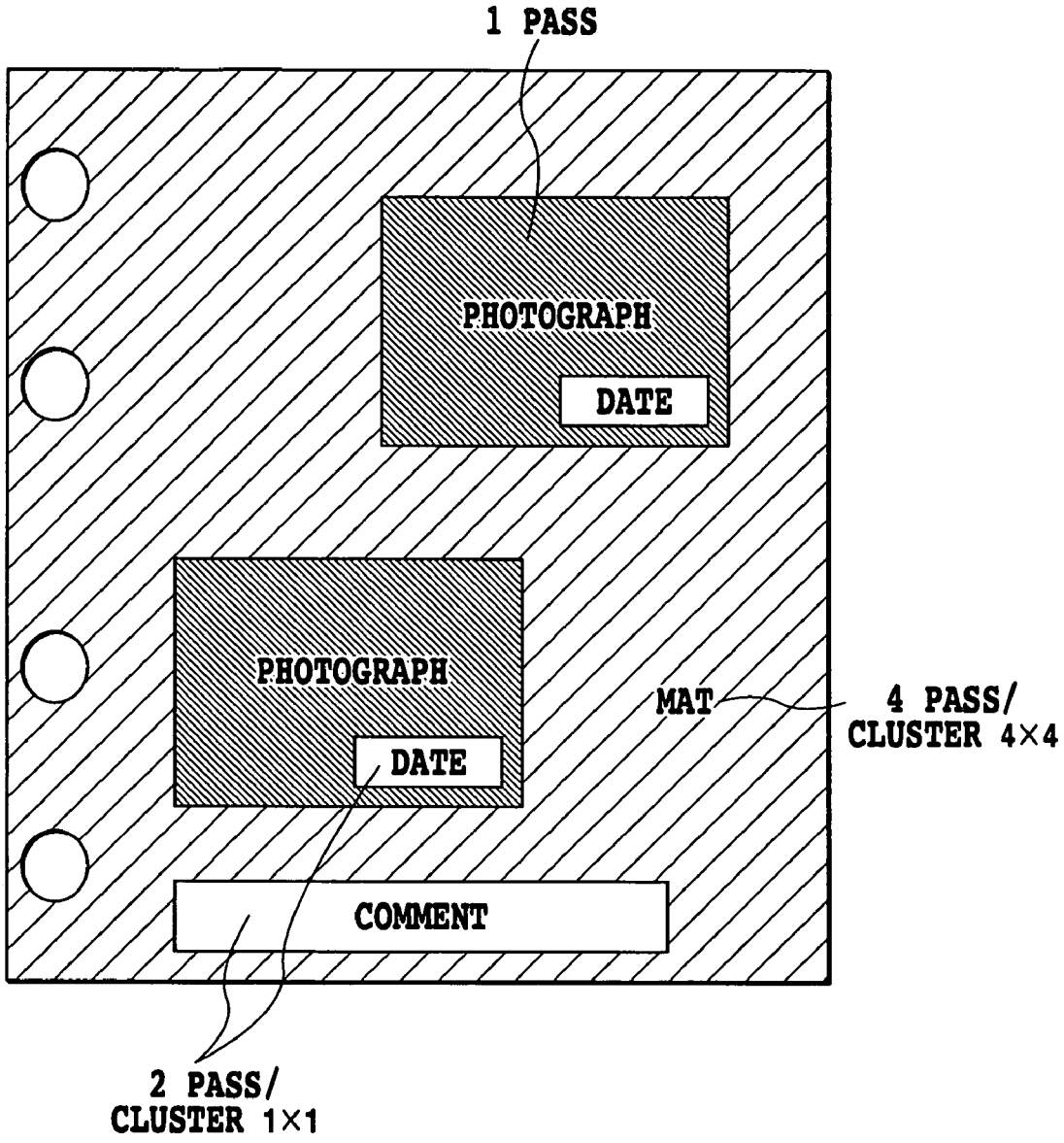
FIG. 8 is a view illustrating a specific example of the control of the degree of gloss and haze according to the embodiment of the present invention.

FIG. 8 is a diagram illustrating an example of the control of the degree of gloss and haze according to the present embodiment.

The example shown in the figure shows that images shot by a digital camera are printed in album form. First, on a personal computer (PC), the shot images are formed into photographs using an album creating application. Further, comments and dates on which the images were shot are inputted and laid out. Then, on the basis of the image data on the PC created as described above, for example, a printer driver on the PC is used to create print data (ink ejection data) and liquid composition ejection data. At this time, the user sets the information on the combinations of the numbers of passes and the cluster sizes or the corresponding plural combinations of the degrees of gloss and haze values, shown in FIG. 7, for, for example, each photograph, comment, data, or mount. In the example shown in the figure, the photographs are set for one pass in order to increase the degree of gloss. The comment and dates are set for two passes and a cluster size of 1×1. The mount is set for four passes and a cluster size of 4×4 because it does not require a high degree of gloss.

The printer driver detects the position of each type of image on the basis of, for example, data in PDL format. Then, on the basis of the information set for each type of image as described above, the printer driver uses a mask corresponding to the set number of passes and the set cluster size to create liquid composition ejection data as ejection data for the liquid composition head for each scan. Then, the printer driver transmits the generated liquid composition ejection data to the printer of the present embodiment for each scan, together with print data. Thus, the printer can print the image shown in FIG. 8. If for example, both photograph and mount are present in the scanning direction of the heads and thus the different numbers of passes must be used, then data on a head for a smaller number of passes is set so that ejection is not carried out during predetermined scans.

The combination information may be set beforehand for each image data, or for example, an appropriate one of the above combinations may be selected on the basis of luminance data contained in the image data.

(Second Embodiment)

A second embodiment of the present invention is related to what provides higher degree of gloss to an image. Further, the degree of gloss and haze are adjusted on the basis of an ejection duty of the liquid composition. FIGS. 9A to 9D show an example of a liquid composition ejecting method according to the present embodiment.

As shown in these figures, in the present embodiment, all the ejection openings are used to eject the liquid composition during one pass (during the first scan), i.e. at an ejection duty of 100%, to form a layer with a high degree of gloss. Then, for the second pass, the ejection duty is changed to adjust the degree of gloss and haze. FIGS. 9A to 9D show that the ejection duty during the second pass is 0, 80, 70, or 60%, respectively. Here, the ejection duty can be represented as the proportion of pixels, to which the liquid composition is ejected, to all pixels in a predetermined area, e.g. the entire scan area of one scan. The ejection duty is 100% when one droplet is ejected to each pixel.

Figure 9A:
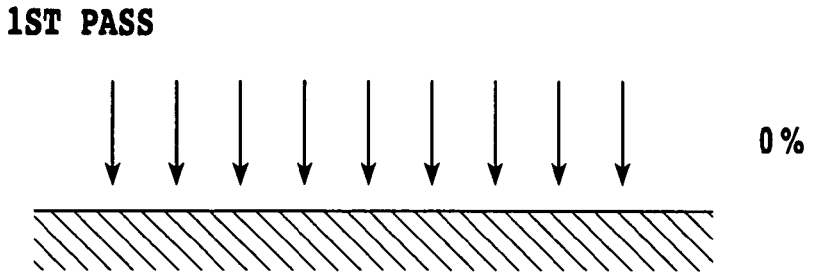
FIGS. 9A to 9D are views showing one example of a liquid composition ejecting method according to a second embodiment of the present invention.

FIG. 9A shows that a coat layer is completed during one scan (during the first pass). Thus, as described for FIG. 5B, a flat layer is obtained and a high degree of gloss of about 99.5 can be achieved. Then, during the second pass, the liquid composition is not ejected (0% duty). Therefore, the high degree of gloss is obtained.

Figure 9B:
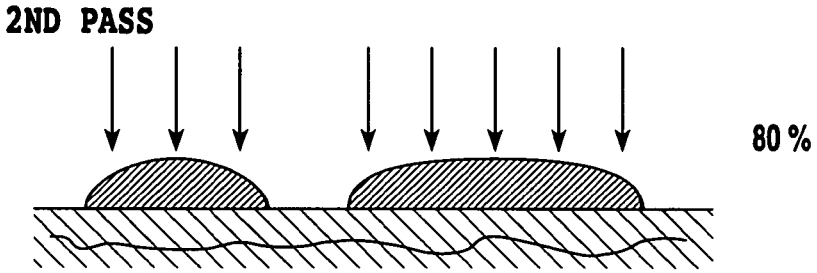
Figure 9C:
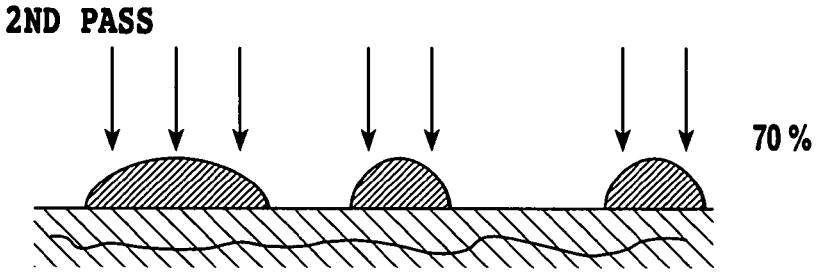
Figure 9D:
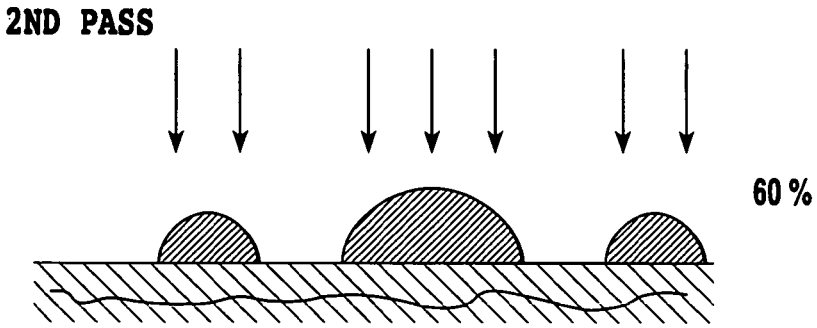

In the cases shown in FIGS. 9B to 9D, during the second scan (second pass), the liquid composition is ejected to the area the degree of gloss of which is to be reduced in accordance with image data, at an ejection duty corresponding to the desired degree of gloss. In these cases, in a layer formed on a layer formed during the first pass, concave portions in which the layer is not formed mainly contribute to reducing the reflectivity if the ejection duty is high (for example, 80%). In contrast, if the ejection duty is low (for example, 60%), the reflectivity is reduced not only by the concave portions in which the layer is not formed but also by convex portion which is formed by the layer. Then, basically, a high degree of gloss is achieved by the layer formed during the first pass. Accordingly, a decrease in the degree of gloss of the entire image in accordance with the number of concaves and convexes is small. As a result, with the control of the degree of gloss shown in these figures, the degree of gloss can be controlled while maintaining a relatively high degree of gloss in every case. The ejection data in the liquid composition data used for this adjustment can be generated using, for example, a mask so as to obtain a predetermined ejection duty.

Further, this layer formation is excellent notably in terms of a gas barrier property. Specifically, since the coat layer is completed during the first scan, the image on the printing medium can be covered in the coated area of the printing medium. Thus, the image can be almost completely closed against a gas such as ozone. On the other hand, if the coat layer is formed using multiple passes instead of one pass, as described for FIG. 5C or 5D, a fine gap may be created between the layers formed during the respective passes. In this case, the printed image is not completely closed against the gas.

Figure 10:
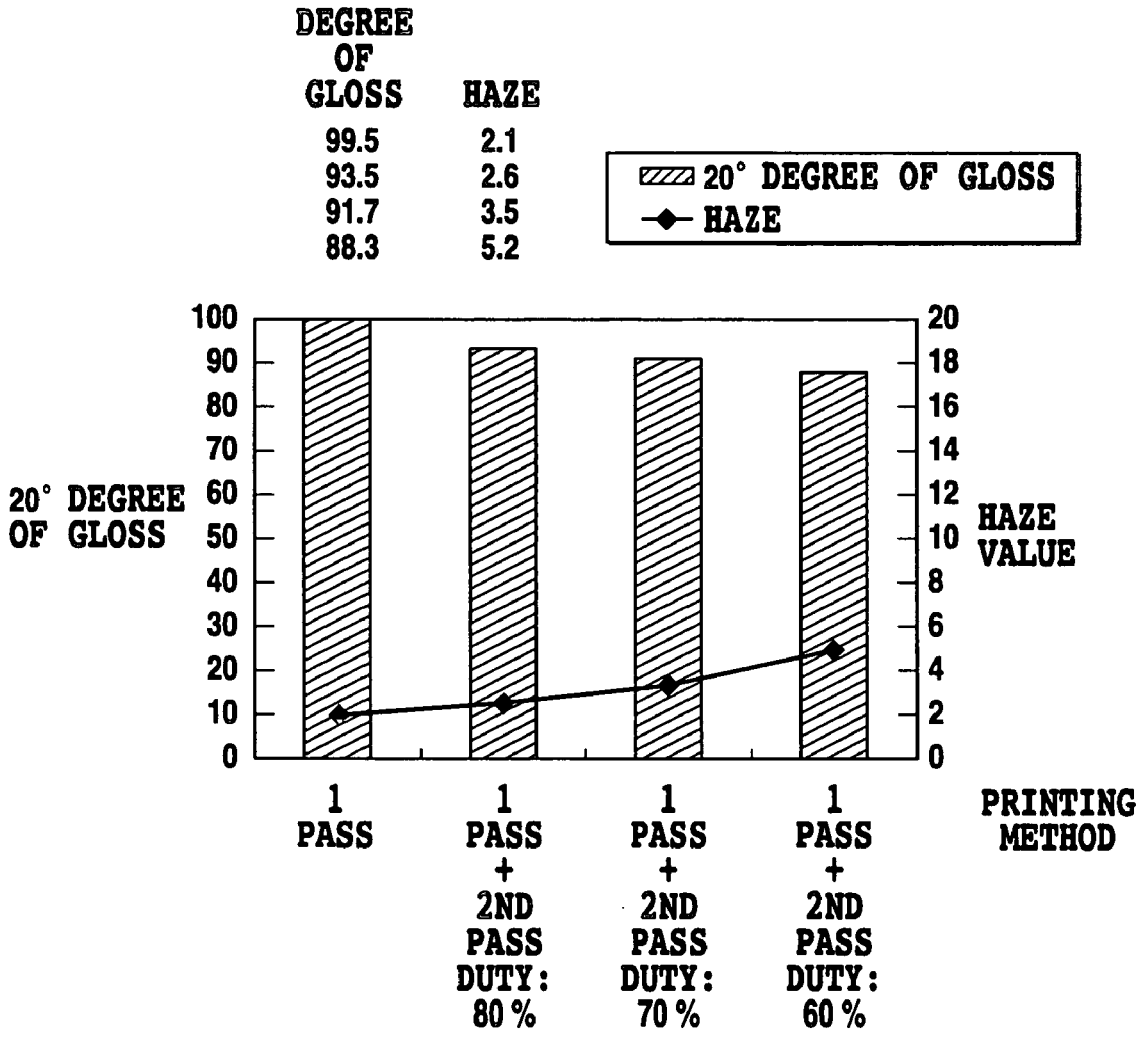
FIG. 10 is a graph showing the degree of gloss and haze which can be set according to the second embodiment of the present invention.

As described above, in the present embodiment, the degree of gloss and haze are varied among the plural levels by varying the manner of ejecting the liquid composition (ejection duty) without varying the number of passes. FIG. 10 shows the degree of gloss and haze that can be set according to the present embodiment, using the layer forming method shown in FIGS. 9A to 9D. Also in the present embodiment, the ejection resolution of the liquid composition is 1,200 dpi and the amount of liquid composition ejected is 4.45 ng. The degree of gloss and haze shown in FIG. 10 are realized on the basis of the sizes of droplets based on the resolution and the amount of liquid composition ejected.

In FIG. 10, the four layer forming manners arranged in order of decreasing degree of gloss correspond to FIGS. 9A to 9D, respectively. In this case, the haze value is relatively small, leading to a clear print with a high degree of gloss.

Thus, when the liquid composition is applied during two passes, the degree of gloss and haze can be controlled among the plural levels by controlling the ejection duty during the second pass.

(Third Embodiment)

In a third embodiment of the present invention, larger sized droplets of the liquid composition are used instead of increasing the number of adjacent droplets as shown in the second embodiment. Specifically, in the case that larger sized droplets are used, when they land on the printing medium and are then insolubilized, the surface formed by the remaining shapes of the droplets has large concaves and convexes. This reduces the degree of gloss.

For example, an arrangement for varying the sizes of droplets varies the ejection amount for each ejection opening by varying the size of the ejection openings or varying the number of elements that generate thermal energy. Then, the ejection openings from which the liquid composition is ejected are selected in accordance with the set degree of gloss. In this regard, the degree of gloss and haze can be more precisely controlled by also using the arrangement for controlling the number of adjacent droplets as described in the second embodiment.

The technique for varying the sizes of droplets is not limited to the above example. For example, with an ink jet method utilizing piezoelectric elements, the ejection amount can be varied among multiple levels by controlling the interaction between timings for vibrating the elements and the natural frequency of a nozzle structure. With the thermal-energy-based bubbling method used in the present embodiment, the speed at which a gas is generated and the like also depend on the temperature of the liquid. Accordingly, the ejection amount can be varied by controlling the temperature of the liquid composition.

(Fourth Embodiment)

Figure 11A:
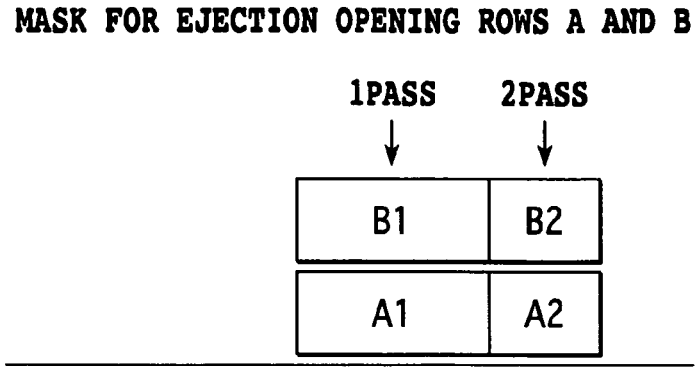
FIGS. 11A to 11C are diagrams showing a fourth embodiment of the present invention.
Figure 11B:
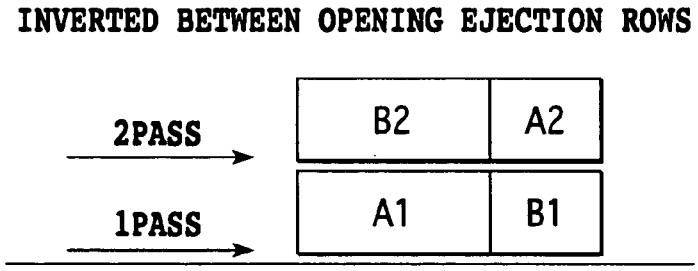
Figure 11C:
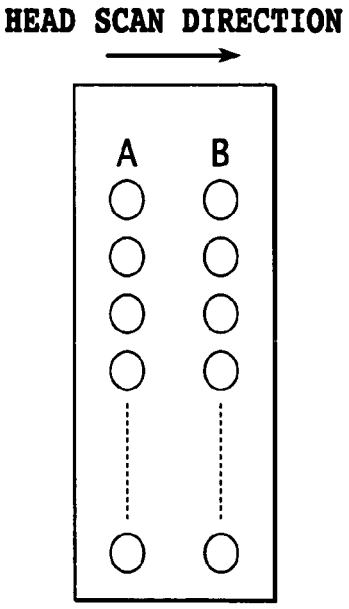

FIGS. 11A to 11C are diagrams illustrating a fourth embodiment of the present invention. As shown in FIG. 11C, the present embodiment uses a head comprising two ejection opening rows (A and B) used to eject the liquid composition. The same amount or different amounts of liquid composition may be ejected from the two ejection opening rows. In the description below, the same amount of liquid composition is ejected from the ejection opening row.

In the present embodiment, duplicate ejection data for the ejection opening rows A and B are generated from the same liquid composition ejection data. On the basis of the ejection data, the liquid composition is ejected during two scans so that the liquid composition ejected during the first scan is superimposed on the liquid composition ejected during the second scan. Then, the degree of gloss is varied by using different masks for generating the liquid composition ejection data.

FIGS. 11A and 11B are diagrams illustrating how the use of different masks differentiates the manner in which the respective liquid compositions ejected during the first and second scans are superimposed on each other. The variation in the manner of superimposing varies the degree of gloss. In these figures, the number 1 added to each of the letters A and B indicates the first scan, whereas the number 2 added to each of the letters A and B indicates the second scan.

The manner of superimposition shown in FIG. 11A corresponds to the case in which the masks used to generate ejection data during each of two scan passes are the same for the ejection opening rows A and B. When the same mask is used for the two ejection opening rows during each scan, the liquid compositions ejected from respective ejection opening rows are superimposed on each other in each scan, as shown in FIG. 11A. That is, during the same scan, droplets of the liquid compositions ejected from the respective ejection openings in the ejection opening rows A and B are ejected to the same area on the printing medium and superimposed on each other. The droplets are then integrated and insolubilized. Subsequently, during the second scan, a mask complementary to the above one is used to eject droplets and they are similarly superimposed on each other. More specifically, the liquid compositions ejected from the respective ejection openings in the ejection opening rows A and B are ejected to the area to which no droplets were ejected during the first scan ejection and are superimposed on each other in this area. The droplets are then insolubilized.

Thus, in the case that the same mask is used during the respective scans, the characteristics of the degree of gloss are basically the same as those in the case of two passes described in the first embodiment. However, since a relatively large amount of liquid composition is ejected to the area to be coated during one scan, a larger area is covered during the first scan, correspondingly increasing the degree of gloss.

FIG. 11B shows the case that complementary masks (having inverted mask data) are used for the respective ejection opening rows in generating ejection data for each scan. In this case, during the same scan, droplets ejected from the ejection openings in the ejection opening row A have a complemental relation to droplets ejected from the ejection openings in the ejection opening row B. Accordingly, the droplets can be completely integrated to form a flat layer. This also applies to the second pass, so that a flat layer is further formed on the layer formed during the first pass. In this case, the degree of gloss is very high.

Figure 12:
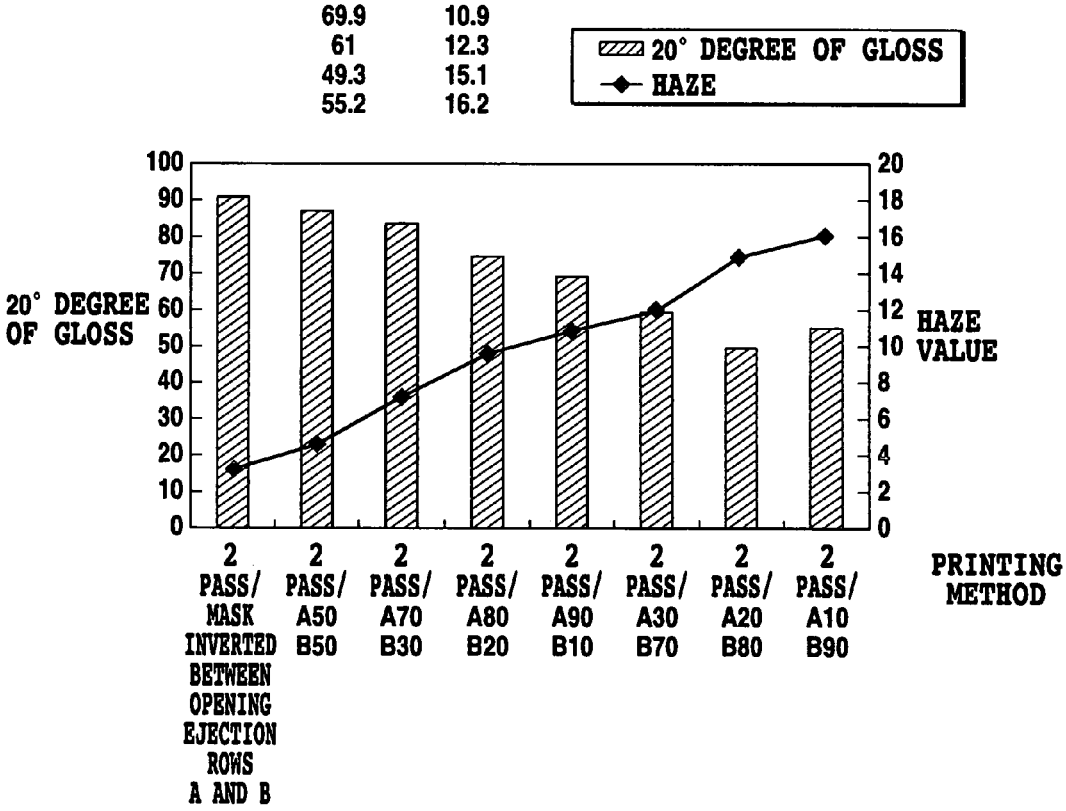
FIG. 12 is a graph showing the degree of gloss and haze which can be set in controlling the degree of gloss and haze using the layer forming method described in FIGS. 11A to 11C.

FIG. 12 is a graph showing the degree of gloss and haze that can be controlled and set using the above described layer forming method.

In this figure, the highest degree of gloss is set in the case that the mask is inverted for the two ejection opening rows during each scan as described for FIG. 11B. In this case, droplets ejected during each of the two scans are almost completely integrated to form a smooth insolubilized layer. This sharply increases the degree of gloss. In the present embodiment, the ejection resolution of the liquid composition is 1,200 dpi and the amount of liquid composition ejected is 4.45 ng. The degree of gloss and haze shown in FIG. 12 are realized on the basis of the sizes of droplets based on these resolution and ejection amount.

In FIG. 12, the second highest degree of gloss is set in the case that the same mask is used during each scan as described for FIG. 11A and the ratio (mask duty) of coverage during the first pass to the coverage during the second pass is set at 50:50. In this case, an amount of liquid composition corresponding to the two ejection opening rows is ejected during the same scan. Consequently, more excess liquid compositions remain on the printing medium every time the droplets land on the printing medium. Thus, when the liquid composition is ejected in the second pass, the droplets landing on the printing media during the first pass have not sufficiently been insolubilized. These droplets are integrated with the droplets of second pass to some degree to increase the degree of gloss by a certain amount. In FIG. 12, layers with the third to fifth highest degrees of gloss are formed by increasing in that order the coverage for the first pass under the condition that the coverage for the first pass is larger than the coverage for the second pass. When the coverage for the first pass is thus larger than the coverage for the second pass, many of areas to be coated during the second pass become isolated points (at these points droplets cannot be connected to others). Thus, in view of landing accuracy of the droplets between passes and the like, the vicinity of the isolated point has a relatively high surface roughness. It is thus assumed that the degree of gloss increases as the coverage during the first pass increases.

In FIG. 12, the sixth to eighth highest degrees of gloss are set by increasing the coverage during the second pass in that order under the condition that the coverage during the second pass is larger than the coverage during the first pass. If the coverage during the first pass is smaller than 50%, more points are isolated during the first pass. An amount of liquid composition corresponding to the two ejection opening rows is ejected during the same scan. Consequently, more excess liquid compositions remain on the printing medium every time the droplets land on the printing medium. However, at isolated points, the liquid composition is absorbed or evaporated at a higher speed and is thus completely insolubilized before the second pass is started. Accordingly, the degree of gloss decreases as the number of isolated points increases. When the ratio of the coverage during the first pass to the coverage during the second pass is 30:70 to 20:80, the degree of gloss decreases. However, when the coverage ratio is as low as 10:90, the coverage during the second pass increases to eliminate the difference between this case and the case in which the coverage ratio is 90:10. Thus, the degrees of gloss in these two cases are relatively close to each other. In this manner, in the fourth embodiment of the present invention, the degree of gloss can also be controlled among the multiple levels.

(Fifth Embodiment)

Like the fourth embodiment, the present embodiment enables the liquid composition to be ejected from the two ejection opening rows as shown in FIG. 11C. Duplicate ejection data for the ejection opening rows A and B are generated from the same liquid composition ejection data. On the basis of the ejection data, during one scan, the liquid compositions are ejected so as to be superimposed on each other.

Unlike the first to fourth embodiments, the present embodiment is characterized in that the liquid composition starts to be insolubilized relatively early.

Specifically, the liquid composition is adjusted so that the liquid composition ejected from the ejection opening row A starts to be insolubilized before the liquid composition ejected from the nozzle row B lands on the printing medium; this time difference is determined by the distance between the ejection opening rows A and B and a scanning speed. Thus, a variation in film quality, which is caused by varying the number of scans in the first to fourth embodiments, is achieved on the basis of this time difference.

(Sixth Embodiment)

Figures 13A, 13B, 13C:
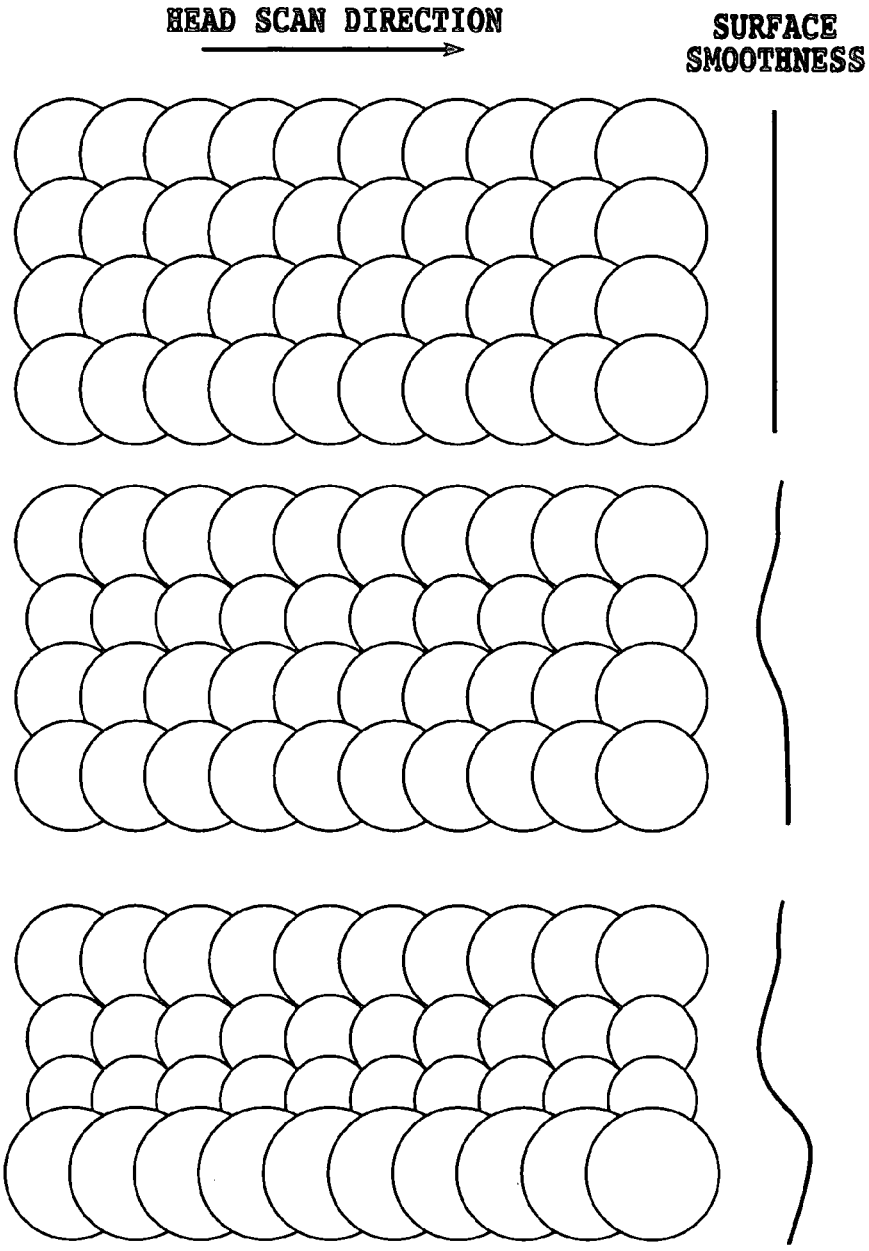
FIGS. 13A to 13C are diagrams illustrating a liquid composition ejecting method according to a sixth embodiment of the present invention.

FIGS. 13A to 13C are diagrams illustrating a liquid composition ejecting method according to a sixth embodiment of the present invention. In the present embodiment, interlace printing is used as a basic printing method. The liquid composition is also ejected using this method.

With the interlace printing, an adjacent raster (a dot line in the scanning direction) is formed during a different scan. In this case, to increase the degree of gloss, it is desirable that time corresponding to at least several scans be required to insolubilize the liquid composition so as to integrate droplets of the liquid composition as well as possible. Further, to achieve this, it is preferable that the liquid composition be not easily absorbed by the printing medium.

FIG. 13A shows that an insolubilized layer is formed by ejecting the same amount of liquid composition for each raster. With the aforementioned physical properties of the ink and the absorbing ability of the printing medium to the ink, a very smooth surface is obtained as a result of the integration of droplets and the absence of differences in size and shape between the droplets.

FIG. 13B shows that a plurality of rasters involve a scan with a smaller amount of liquid composition ejected. In this case, even if a time equal to several scans is required to insolubilize the liquid composition so as to facilitate the integration, the shapes of the droplets observed upon landing remains to some degree. Thus, linear recesses are formed in the scanning direction to reduce slightly the degree of gloss. However, the recesses are formed at so small pitches that they cannot be visually perceived easily.

FIG. 13C shows that a plurality of rasters are formed by three types of scans. In this case, as in the case with FIG. 13B, recesses are formed to reduce the degree of gloss by a certain amount. However, the resultant stripes cannot be perceived easily.

Figure 14:
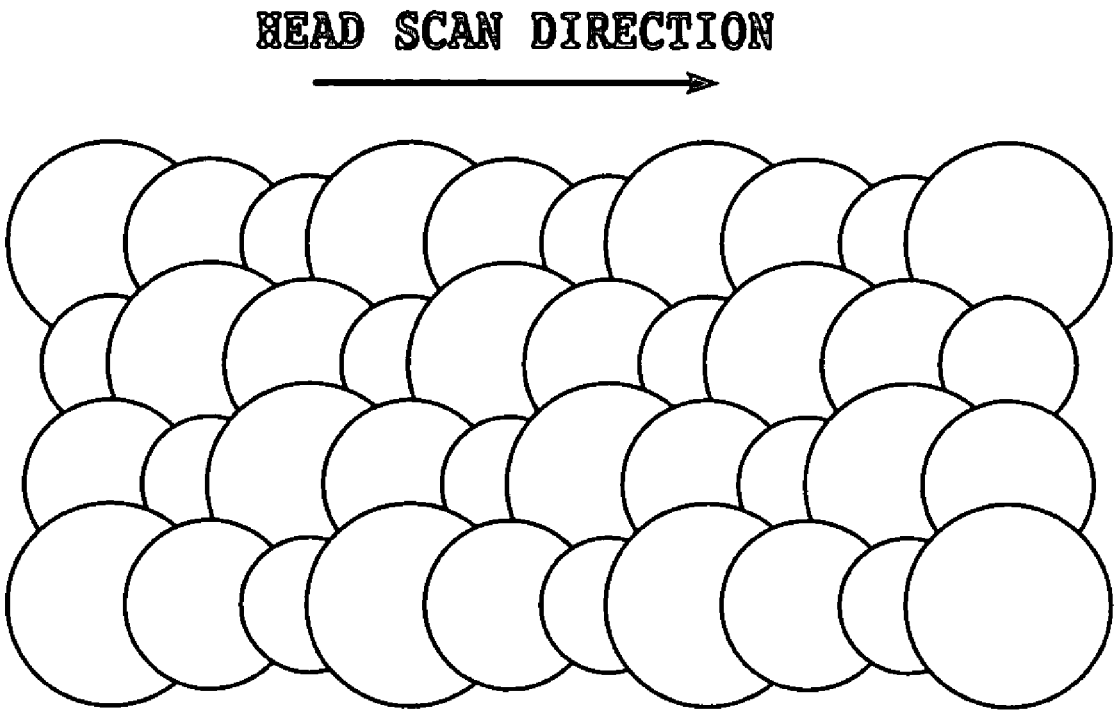
FIG. 14 is a diagram showing an example in which droplets of a liquid composition having a plurality of sizes are ejected during one scan of interlace printing similar to that shown in FIGS. 13A to 13C.

Furthermore, FIG. 14 shows an example in which similar interlace printing is executed to eject, during one scan, droplets of the liquid composition which have a plurality of sizes. In this case, although the droplets are integrated, their original shapes or sizes remain to some degree. The surface of the insolubilized layer has more concaves and convexes to reduce the degree of gloss. In this manner, the degree of gloss can be controlled among the multiple levels by controlling the modulation of the ejection amount during one scan as well as a modulation rate.

As described above, in the description of the examples in the first to sixth embodiments, the acid on the printing medium causes the polymer in the liquid composition to be insolubilized to separate the polymer from the liquid composition. Thus, the printing medium absorbs the solvent component to form an insolubilized solid layer on the printing medium. However, the formation of an insolubilized layer is not limited to this aspect. For example, a photo-setting resin may be dispersed in the liquid composition, and after ejection, the liquid composition may be irradiated with light to form a set layer. Alternatively, a thermosetting resin may be dispersed in the liquid composition, and after ejection, the liquid composition maybe heated. Alternatively, a reaction form may be used in which a resin component in the liquid composition contacts with the ink and is then separated from the liquid composition.

Further, as a form of a printing apparatus, the serial ink jet printer has been cited which uses the ink jet head having the integrated ink and liquid-composition ejection openings. However, the present invention is not limited to this configuration; any configuration is used provided that the present invention is applicable to it. For example, the ink heads may be separated from the liquid composition head. Alternatively, instead of the serial ink jet printer, some forms of ink jet printer may be used which have a full line head requiring no carriage scans.

As described above, according to the embodiments of the present invention, the predetermined droplets are applied to the surface of the printing medium to form a layer so as to vary the degree of gloss of, for example, an image printed on the printing medium among a plurality of levels. Consequently, the degree of gloss can be varied among a plurality of levels simply by varying the manner of applying the droplets in forming the layer.

Further, according to other embodiments, when the predetermined droplets are applied to the surface of the printing medium to form a layer, the degree of gloss is varied, for example, by controlling the level of integration of the predetermined droplets applied to form the layer. This makes it possible to set the shapes and sizes of the plurality of droplets applied to the printing medium when they are integrated. Thus, the degree of gloss can be varied by controlling the irregularity or roughness of the surface of the layer.

Further, in the above structure, when the ink jet head is used for scanning the printing medium to eject the predetermined droplets to form a layer, the degree or gloss can be varied by varying the number of scans or data on each scan.

Furthermore, since the above layer is formed on the surface of the printing medium on which the image is formed, the image can be closed relative to the atmosphere.

Further, in addition to a function for controlling the degree of gloss and the haze adequately, a function as gas resistant barrier for a print image can be improved. As described before in FIGS. 9A to 9D, the layer of embodiment shown in this figure has specially improved function as gas resistant barrier. However, respective layers of other embodiments can also function as a given gas resistant barrier by coating the surface of a print image.

As a result, for a print (printed material), a plurality of steps of the degree of gloss can be expressed with a simple arrangement and a keeping quality of print image can be improved.

(Seventh Embodiment)

Figure 15A:
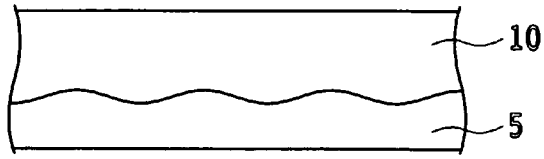
FIGS. 15A to 15C are views and a graph illustrating a liquid composition ejecting method according to a seventh embodiment of the present invention.
Figure 15B:
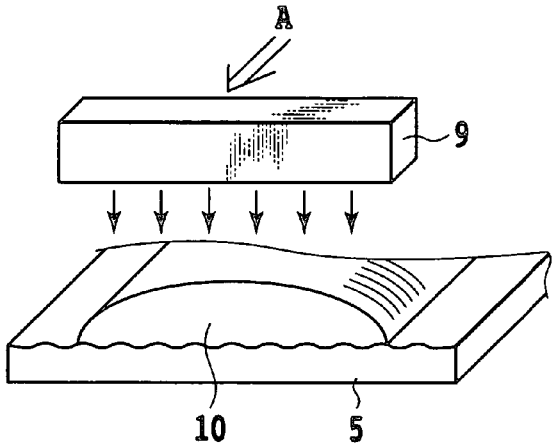
Figure 15C:
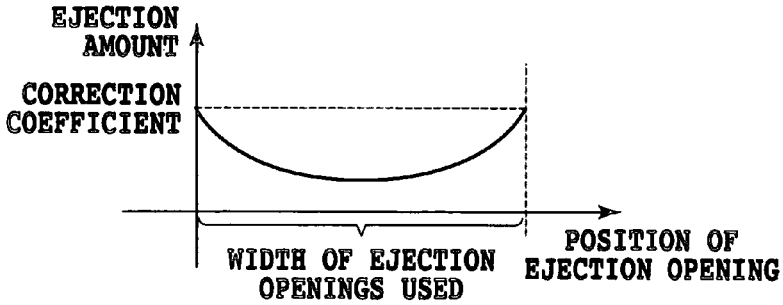

A seventh embodiment of the present invention relates to a liquid composition ejecting method for suppressing a gloss nonuniformity and interference fringes that may occur in each scan area of a printing head, when a serial type printing head ejects the liquid composition to form a coat layer. FIGS. 15A to 15C are diagrams illustrating this liquid composition ejecting method.

The liquid composition used in the embodiments of the present invention is insolubilized by the acid of the printing medium, and droplets ejected during one scan of the liquid composition head (ejection opening row 9) are substantially integrated upon contacting with the printing medium 5. In the present embodiment, the ejection resolution of the liquid composition and the diameters of droplets of the liquid composition on the printing medium 5 are designed so that a coat layer 10 can be formed during one scan utilizing the above integration phenomenon. This arrangement can provide a coated layer, which is formed during one scan, so that the surface of the layer has high smoothness to give high degree of gloss.

However, as shown in FIG. 15B, when the amount of liquid composition ejected during one scan is the same for the plurality of ejection openings constituting the ejection opening row 9, the layer 10 formed has its center raised. This is because some droplets of the liquid composition which land on the position of the ends of a layer to be formed permeate faster through the printing medium and are thus likely to form a thinner layer, while plural droplets of the liquid composition which land on the position of the center permeate more slowly through the printing medium and thus form a layer thicker than the end of the layer. Another reason is that the landing droplets of the liquid composition are connected together before insolubilization, so that the surface tension of the liquid composition is likely to raise the center of the layer. Such a layer is formed every time the head, which ejects the liquid composition, is employed for scan. Consequently, the ends of the layer, which is thinner and constitutes the boundary of each scan area, causes gloss nonuniformity or interference fringes. Of course, such a boundary is formed not only if all the ejection openings are used but also if a plurality of ejection openings constituting a part of the ejection opening row 9 are used for scans.

In the present embodiment, ejection amount correction such as that shown in FIG. 15C is carried to minimize such a variation in thickness at the end of the layer. Specifically, an ejection amount correction coefficient is varied in accordance with the position of the ejection opening during a scan. This coefficient can be used to correct liquid composition ejection data for each ejection opening so as to set a larger ejection amount for the end and a smaller ejection amount for the center. Specifically, the liquid composition head according to the present embodiment comprises a plurality of, e.g. two ejection heaters in a path corresponding to each ejection opening. Thus, the ejection amount can be switched among, for example, three levels in association with the number of ejection heaters driven. Then, ejection data for each ejection opening is corrected with reference to the correction table shown in FIG. 15C to generate ejection data corresponding to one of the new three levels. Then, on the basis of the corrected ejection data, the liquid composition head is driven to carry out ejection with one of the three ejection amounts. As a result, for example, the largest one of the three ejection amounts is used for the terminal ejection opening. The second largest ejection amount is used for some ejection openings adjacent to the terminal one. The smallest ejection amount is used for the other ejection openings.

In this manner, control is provided so that a larger amount of liquid composition is ejected to the end of the layer, which may be thinner, whereas a smaller amount of liquid composition is ejected to the center. This makes the thickness of the entire layer uniform. If the ejection openings used during one scan have a relatively large, the center of the liquid composition layer may be almost flat and may not substantially be raised. In this case, of course, a larger ejection amount may be used for the end as described above.

Figure 16A:
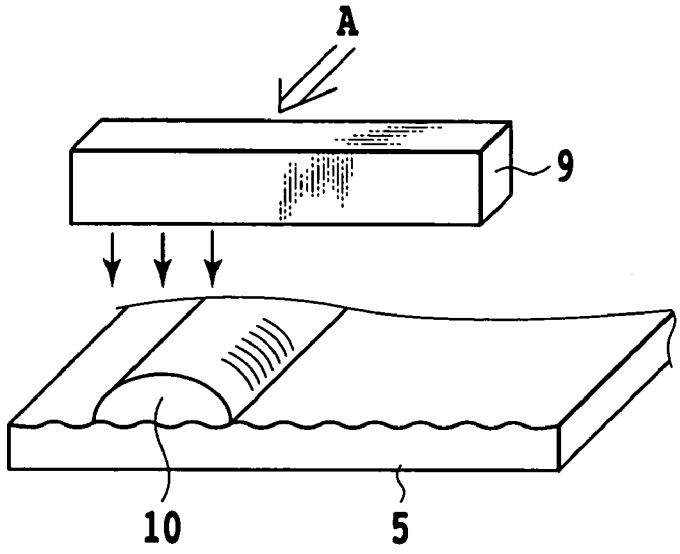
FIGS. 16A and 16B are views illustrating a variation in the thickness of a liquid composition layer depending on the number of ejection openings used during one scan.
Figure 16B:
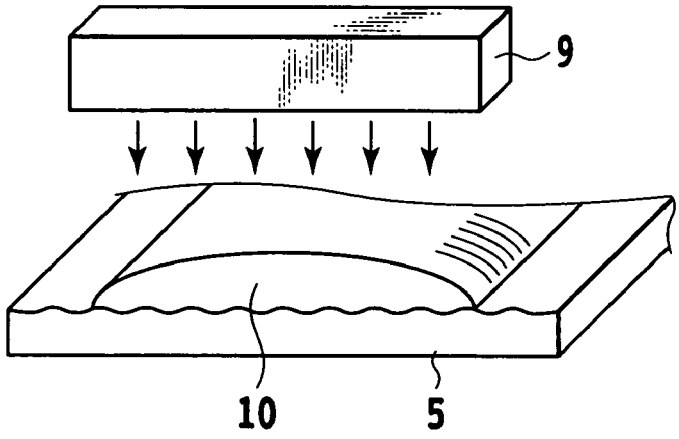

On the other hand, if a small number of ejection openings are used during one scan as shown in FIG. 16A, the thickness varies markedly. Accordingly, the curve for the ejection amount correction coefficient must be correspondingly sharp. On the other hand, as shown in FIG. 16B, if a large number of ejection openings are used during one scan, the thickness of the liquid composition layer varies insignificantly. Accordingly, the curve for the ejection amount correction coefficient must be correspondingly gentle.

Figure 17:
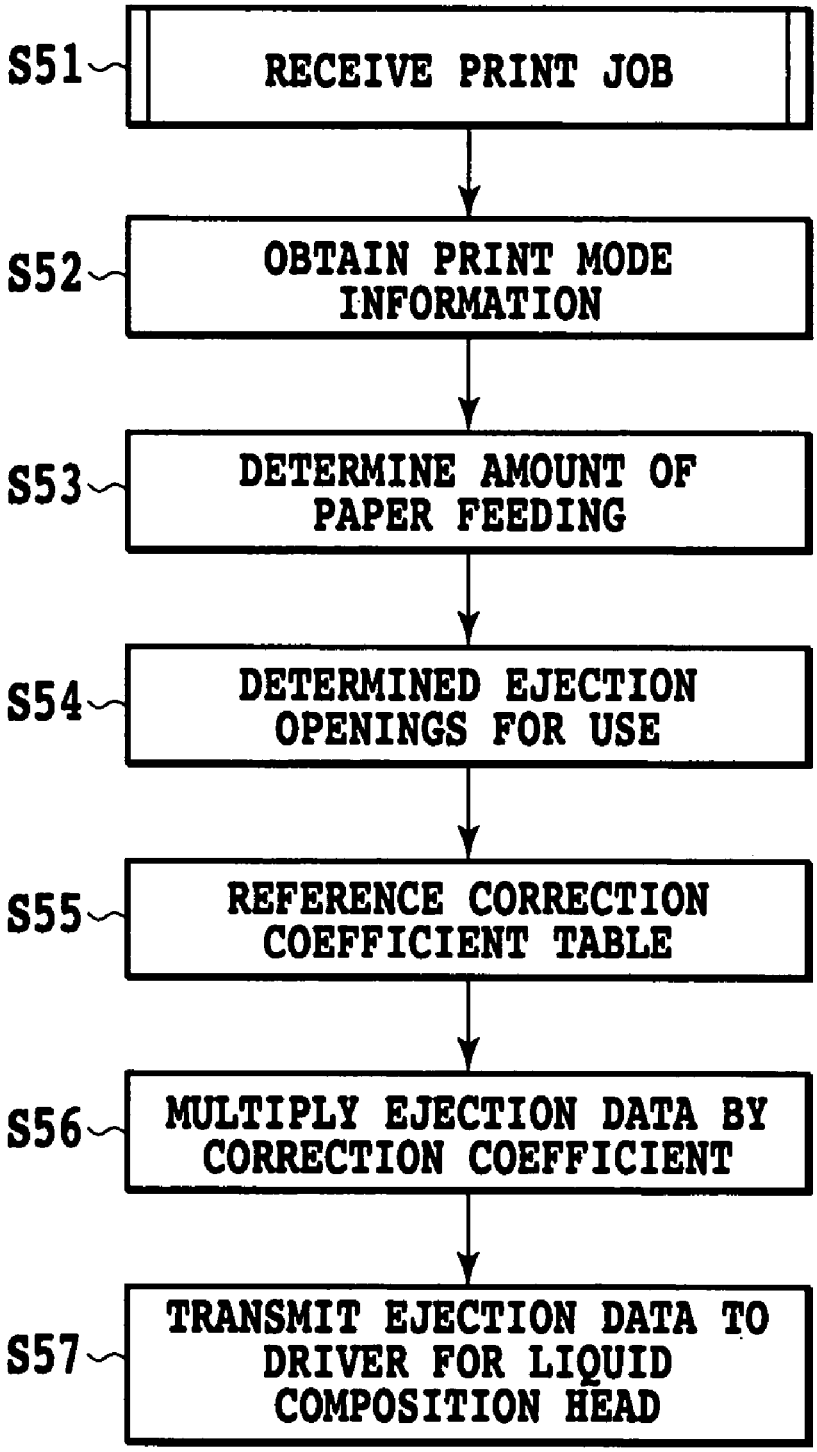
FIG. 17 is a flow chart showing a process relating to the generation of ejection data according to the seventh embodiment of the present invention.

FIG. 17 is a flow chart showing processing executed to generate ejection data according to the present embodiment.

As shown in this figure, a printer according to the present embodiment receives a print job from a host computer (S51). The printer thus obtains print mode information transmitted with the print job (S52). This information contains information on the number of passes used to print an image. Thus, the printer determines the amount of paper fed when the liquid composition is ejected on the basis of the number of passes, as described previously for FIGS. 4A and 4B (S53).

When the paper feed amount is determined, the printer determines the number of ejection openings used to eject the corresponding liquid composition (S54). The printer then determines a correction coefficient for each ejection opening with reference to a table for ejection amount correction coefficients corresponding to the numbers of ejection openings which table is stored in a ROM or the like (S55). In the present embodiment, the liquid composition is ejected during one scan (one pass) as described previously for FIGS. 4A and 4B.

Then, the printer multiplies the ejection data for each ejection opening by the correction coefficient determined above to obtain ejection data for one of the three ejection amounts (S56). Finally, the printer transfers the ejection data obtained to a driver for the liquid composition head while synchronizing with scan timings for the liquid composition head. The printer then ejects the liquid composition to an area to be made glossy.

The above processing results in ejection data with the ejection amount corrected, thus enabling the formation of a flat coat layer.

(Eighth Embodiment)

Like the above seventh embodiment, an eighth embodiment of the present invention relates to a liquid composition ejecting method for suppressing the gloss nonuniformity and the interference fringes. The eighth embodiment includes the case in which multi-pass scans are used to eject the liquid composition.

Figure 18:
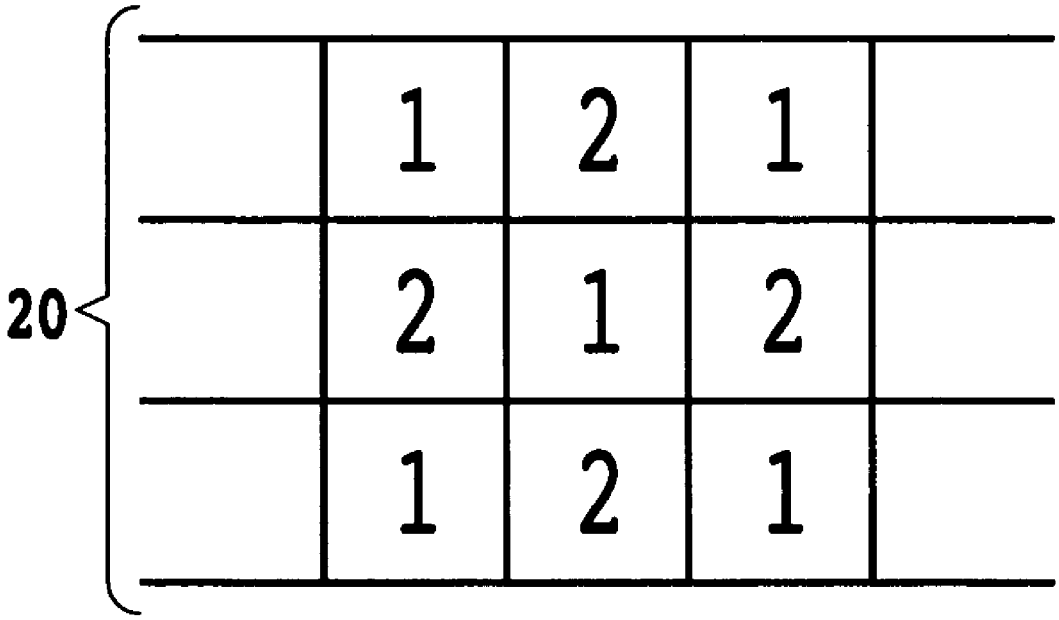
FIG. 18 is a diagram showing an ejection pattern for the liquid composition according to an eighth embodiment of the present invention.

FIG. 18 is a diagram showing an ejection pattern for the liquid composition according to the present embodiment. In the description of the example in the seventh embodiment, all the ejection openings corresponding to the paper feed amount are used to form, during one scan, a coat layer of a width substantially equal to the paper feed amount. In the present embodiment, using the mode in which the liquid composition layer is formed during one scan as described above as well as some of the ejection openings corresponding to the paper feed amount, a coat layer of a width substantially equal to the paper feed amount is formed during a plurality of, specifically two scans.

In the ejection pattern shown in FIG. 18, a width 20 corresponds to the paper feed amount. For the area shown by reference numeral 1, the liquid composition is ejected during one scan to form a coat layer. For the area shown by reference numeral 2, the liquid composition is ejected during two scans to form a coat layer. That is, in the present embodiment, two scans are used to form a coat layer in the area of the width corresponding to the paper feed amount.

Figure 19A:
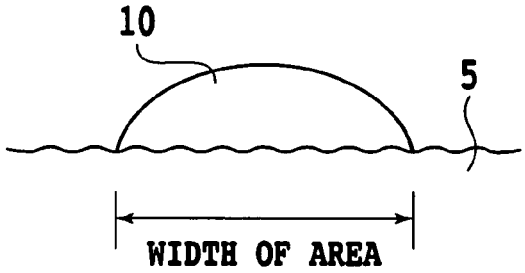
FIGS. 19A to 19C are diagrams illustrating the correction of the amount of liquid composition ejected according to the eighth embodiment of the present invention.

FIG. 19A is a diagram showing a cross section of the liquid composition layer in each of the above areas denoted by the reference numerals in the case in which the correction of ejection data according to the present invention is not carried out. As shown in the figure, in each area, the layer is formed to rise from its end toward its center. This area is obtained by dividing the pattern so that the width corresponding to the paper feed amount is divided by three and that the dimension in the scanning direction is set equal to the one-third of the width. If ejection is carried out using a pattern such as the one shown in FIG. 18, a multi-pass operation with two passes, described in FIGS. 4A and 4B, can be performed.

Further, the above description refers to a square with a side that is one-third of the width corresponding to the paper feed amount. However, the present invention is not limited to this aspect. The present invention is also applicable to a square of a different size or other shapes such as a rectangle and a triangle.

Figure 19B:
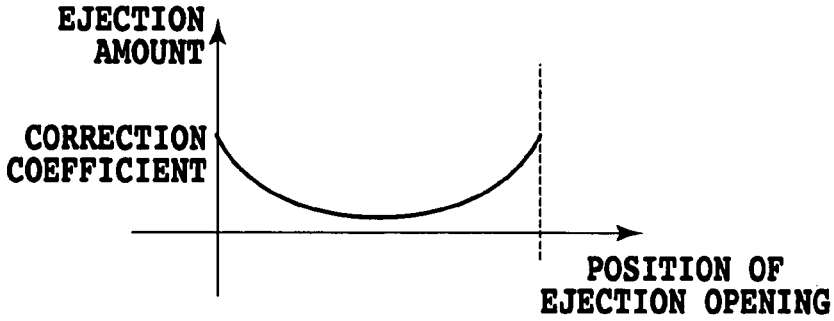
Figure 19C:
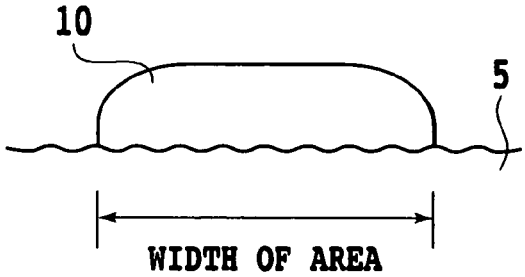

In the present embodiment, the correction curve shown in FIG. 19B is used to correct ejection data for the ejection openings which causes the liquid composition to the area from its end to center. Thus, as shown in FIG. 19C, the liquid composition layer becomes almost flat. This improves the smoothness of the entire coat layer and the impression of gloss and prevents gloss nonuniformity or interference fringes that may be caused by the nonuniform degree of gloss at the boundary of each areas or each scan area.

Figure 20:
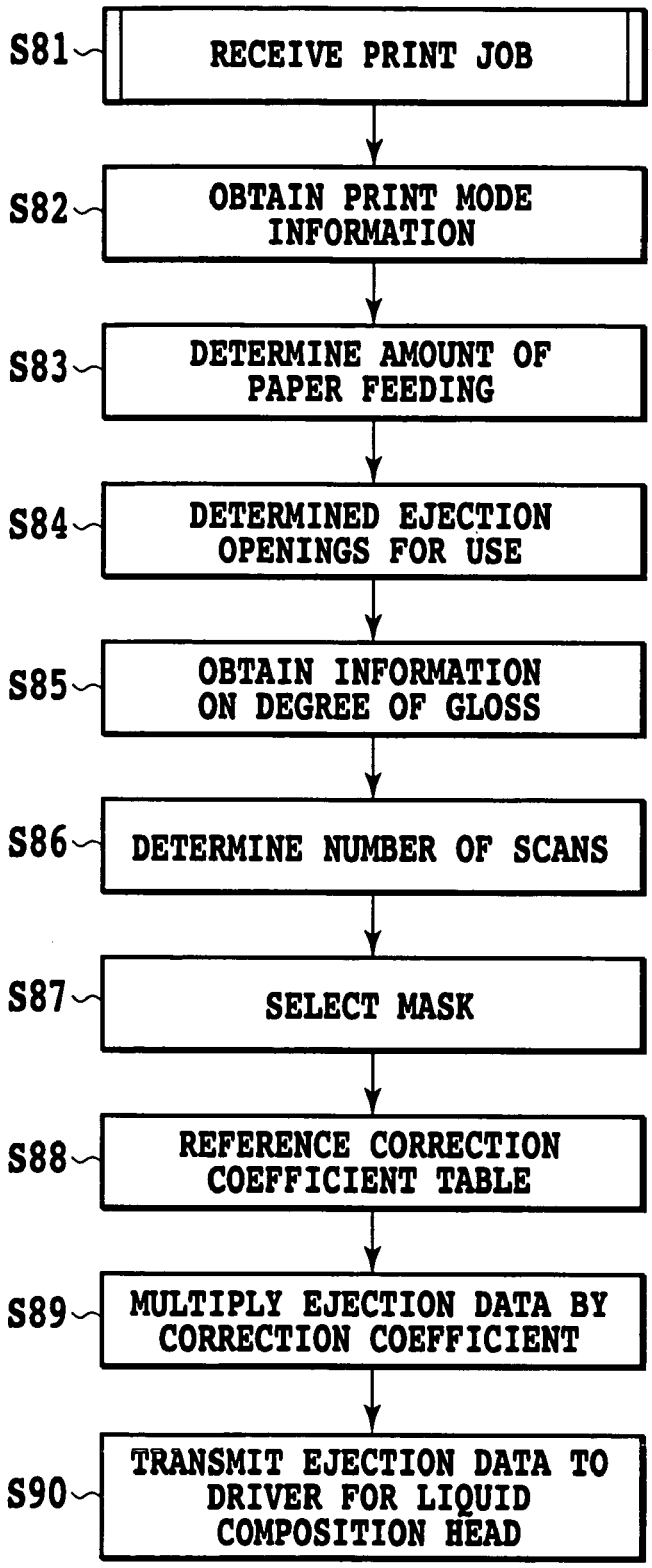
FIG. 20 is a flowchart showing the generation of ejection data according to the eighth embodiment of the present invention.

FIG. 20 is a flow chart showing processing executed to generate ejection data according to the present embodiment.

Steps S81 to S84 are similar to steps S51 to S54, shown in FIG. 17.

After the ejection openings have been determined in step S84, the printer obtains specified degree of gloss information (S85). In accordance with the information obtained, the printer determines the number of scans required to form a coat layer (S86). The relationship between the degree of gloss and the number of scans is generally such that the degree of gloss decreases with increasing number of scans required to form a layer. This is because as the number of scans and the number of areas into which a layer to be formed is divided increase, the surface of the resultant layer has more concaves and convexes and reflects less of incident light.

After determining the number of scans, the printer selects a mask corresponding to this number of scans (S87). By referencing the correction coefficient table corresponding to this mask (S88), the printer corrects ejection data. Specifically, the printer multiplies a coefficient obtained with reference to the correction coefficient table in accordance with the ejection position, with respect to the ejection data for this scan obtained by the process using the mask, to generate, for example, ejection data for one of the three ejection amounts (S89). Then, the printer transfers the liquid composition ejection data for each scan determined as described above to the driver for the liquid composition head to eject the liquid composition (S90).

Of course, the variation in ejection amount is not limited to the above example. For example, the ejection amount can be varied by using a double pulse to drive the ejection heater and varying the width of a prepulse depending on the ejection data corrected using the correction coefficient. Further, with piezoelectric heads, the ejection amount can be varied by varying a voltage applied to elements.

Further, the technique shown above uses the acid of the printing medium to insolubilize instantaneously the polymer in the liquid composition to separate the polymer from the liquid composition. Accordingly, the printing medium absorbs only the solvent component to form a coat layer on it. However, the present invention is not limited to this aspect. Any technique may be used provided that for example, the liquid composition ejected using a liquid ink jet method forms a coat layer on the printing medium. For example, a photo-setting resin may be dispersed in the liquid composition, and after ejection, the liquid composition may be irradiated with light. Alternatively, a thermosetting resin may be dispersed in the liquid composition, and after ejection, the liquid composition may be heated. Alternatively, a reaction form may be used in which a resin component in the liquid composition contacts with the ink and is then separated from the liquid composition. Moreover, as a form of an apparatus, the serial ink jet printer has been cited which uses the head having the integrated ink and liquid-composition ejection openings. However, the present invention is not limited to this configuration; any configuration is used provided that the present invention is applicable to it. For example, the ink heads may be separated from the liquid composition head. Alternatively, any print producing apparatus may be used which ejects only the liquid composition to an existing print to adjust only the degree of gloss.

As described above, according to seventh and eighth embodiments of the present invention, the liquid head provided with the plurality of ejection openings and ejecting the predetermined liquid is employed for scanning in the direction different from that in which the plurality of ejection openings are arranged. Then, the head ejects the predetermined droplets to the printing medium to form a layer on it to provide the image with gloss. Inn this case, the amount of the predetermined liquid ejected is varied for each of the plurality of ejection openings in accordance with the position of this ejection opening in the arrangement direction. Accordingly, it is possible to increase the amount of liquid ejected from the ejection opening located at an end of the ejection opening arrangement and adjacent to the boundary of the scan area with the head and from which the predetermined liquid is ejected, compared to the other ejection openings. This makes it possible to prevent a decrease in the thickness of the layer, notably at the boundary of the scan area, the layer being formed by insolubilizing the predetermined liquid on the printing medium during each scan. It is thus possible to suppress a variation in the shape of the layer at the boundary of the scan area. As a result, the nonuniformity of gloss or the occurrence of interference fringes can be prevented which is caused by a variation in the thickness of the layer at the boundary.

As a result, a print having high degree of gloss with suppressing an interference pattern and a gloss nonuniformity can be provided.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A print producing method of producing a print that is made of a printing medium on which ink is applied, said method comprising the steps of:

applying ink to the printing medium by means of ink applying means while scanning the ink applying means relatively to the printing medium;

applying a liquid for changing a degree of gloss by means of liquid applying means on the printing medium to which the ink has been applied, while scanning the liquid applying means relatively to the printing medium; and setting at least one of a liquid applying condition relating to an applying time difference between the liquid applied to adjacent locations on the printing medium, a liquid applying condition relating to a number of times of scan for applying the liquid, and a liquid applying condition relating to complementary mask patterns used for applying the liquid in a plurality of scans, wherein different liquid applying conditions are set for making different degrees of gloss respectively.

2. A method as claimed in claim 1, further comprising the step of forming a layer of the liquid on the surface of the printing medium by employing said liquid applying step, said layer forming step controlling a level of integrating a plurality of the liquid, which are applied for forming the layer, to vary the degree of gloss.

3. A method as claimed in claim 2, wherein said layer forming step controls application of the plurality of liquid so that the plurality of liquid are dividedly applied at intervals, each of which has a time equal to or longer than a predetermined time, to control the level of integrating the plurality of the liquid.

4. A method as claimed in claim 3, wherein said layer forming step varies applying rates of respective divided liquid to control the level of integrating the plurality of the liquid.

5. A method as claimed in claim 2, wherein said layer forming step varies the number of the liquid applied adjacently to each other within a predetermined time to control the level of integrating the plurality of the liquid.

6. A method as claimed in claim 2, wherein said layer forming step forms a first layer by application of the liquid to an area of the printing medium to which the layer is to be formed and applies the plurality of liquid on the first layer to control the level of integrating the plurality of the liquid.

7. A method as claimed in claim 2, wherein said layer forming step forms a first layer by application of the liquid to all areas of the printing medium and applies the plurality of the liquid on the first layer to control the level of integrating the plurality of the liquid.

8. A method as claimed in claim 2, wherein said layer forming step controls application of the plurality of the liquid so that the plurality of the liquid varies in size among a plurality of sizes to control the level of integrating the plurality of the liquid.

9. A method as claimed in claim 1, wherein a haze of the printing medium is also varied among a plurality of levels in connection with forming a layer with the liquid applied.

10. A method as claimed in claim 1, wherein the liquid contains an aqueous medium and a polymer having the structure formulated by the general formula shown below, and the polymer is insolubilized when the liquid is applied to the printing medium so that the liquid is insolubilized on the surface of the printing medium, formula—COOA in this formula, "A" denotes alkali metal, amine, or organic amine.

11. A method as claimed in claim 10, wherein the surface of the printing medium has a pH contributing to insolubilize the polymer.

12. A method as claimed in claim 1, wherein an ink receiving layer of the printing medium contains polyvalent metal ions of such a concentration as insolubilizes the polymer.

13. A method as claimed in claim 1, wherein said liquid applying step applies the liquid so that a plurality of parts different in the degree of gloss are formed on the same printing medium.

14. A method as claimed in claim 1, said layer forming step is executed by ejecting the liquid from an ink jet head provided with a plurality of nozzles.

15. An apparatus for producing a print product by applying ink on a printing medium, comprising:

a liquid applying unit which applies to the printing medium, a liquid containing an aqueous medium and a polymer;

a scanning device which relatively scans the liquid applying unit to the printing medium;

a controller which controls said liquid applying unit so that, in the scan, the liquid is applied to the printing medium to which the ink has been applied, based on at least one of a liquid applying condition relating to an applying time difference between the liquid applied to adjacent locations, a liquid applying condition relating to a number of times of scan for applying the liquid, and a liquid applying condition relating to complementary mask patterns used for applying the liquid in a plurality of scans; and wherein said controller changes at least one of the liquid applying conditions so as to realize different degree of gloss.

16. A print producing method of producing a print that is made of a printing medium on which ink is applied, said method comprising the steps of:

applying ink to the printing medium by means of ink applying means while scanning the ink applying means relatively to the printing medium;

applying a liquid for changing a degree of gloss by means of liquid applying means on the printing medium to which the ink has been applied, while scanning the liquid applying means relatively to the printing medium; and setting a liquid applying condition relating to an applying time difference between the liquid applied to adjacent locations on the printing medium, wherein different liquid applying conditions are set for making different degrees of gloss respectively.

17. A print producing method of producing a print that is made of a printing medium on which ink is applied, said method comprising the steps of:

applying ink to the printing medium by means of ink applying means while scanning the ink applying means relatively to the printing medium;

applying a liquid for changing a degree of gloss by means of liquid applying means on the printing medium to which the ink has been applied, while scanning the liquid applying means relatively to the printing medium; and setting a liquid applying condition relating to a number of times of scan for applying the liquid, wherein different liquid applying conditions are set for making different degrees of gloss respectively.

18. A print producing method of producing a that is made of a printing medium on which ink is applied, said method comprising the steps of:

applying ink to the printing medium by means of ink applying means while scanning the ink applying means relatively to the printing medium;

applying a liquid for changing a degree of gloss by means of liquid applying means on the printing medium to which the ink has been applied, while scanning the liquid applying means relatively to the printing medium; and setting a liquid applying condition relating to complementary mask patterns used for applying the liquid in a plurality of scans, wherein different liquid applying conditions are set for making different degrees of gloss respectively.

* * * * *

UNITED STATES PATENT AND TRADEMARK OFFICE

CERTIFICATE OF CORRECTION

PATENT NO. : 7,121,660 B2
APPLICATION NO. : 10/676427
DATED : October 17, 2006
INVENTOR(S) : Daisaku Ide et al.

It is certified that error appears in the above-identified patent and that said Letters Patent is hereby corrected as shown below:

At Column 31:
Line 2, after "liquid applying means", insert --to an area--.

At Column 33:
Line 1, delete "producing a that" and insert --producing a print that--.

Signed and Sealed this

Nineteenth Day of December, 2006

JON W. DUDAS
*Director of the United States Patent and Trademark Office*